US009587861B2

(12) United States Patent
Yamashita et al.

(10) Patent No.: US 9,587,861 B2
(45) Date of Patent: Mar. 7, 2017

(54) AIR-CONDITIONING APPARATUS

(75) Inventors: Koji Yamashita, Tokyo (JP); Hiroyuki Morimoto, Tokyo (JP); Yuji Motomura, Tokyo (JP); Junichi Ue, Tokyo (JP); Shinichi Wakamoto, Tokyo (JP); Naofumi Takenaka, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 625 days.

(21) Appl. No.: 13/816,982

(22) PCT Filed: Sep. 14, 2010

(86) PCT No.: PCT/JP2010/005590

§ 371 (c)(1),
(2), (4) Date: Feb. 14, 2013

(87) PCT Pub. No.: WO2012/035573

PCT Pub. Date: Mar. 22, 2012

(65) Prior Publication Data

US 2013/0139539 A1 Jun. 6, 2013

(51) Int. Cl.
*F25B 13/00* (2006.01)
*F25B 7/00* (2006.01)
(Continued)

(52) U.S. Cl.
CPC ..... *F25B 30/02* (2013.01); *F25B 13/00* (2013.01); *F25B 25/005* (2013.01);
(Continued)

(58) Field of Classification Search
CPC ..... F25B 30/02; F25B 13/00; F25B 25/005; F25B 2313/006; F25B 2313/0231;
(Continued)

(56) References Cited

U.S. PATENT DOCUMENTS 2,893,218 A * 7/1959 Harnish ..... 62/180
6,006,528 A * 12/1999 Arima et al. ..... 62/185
(Continued)

FOREIGN PATENT DOCUMENTS

JP 55-130148 U 3/1979
JP 05-280818 A 10/1993
(Continued)

OTHER PUBLICATIONS

Machine translation of JP 2002-267289.*
(Continued)

*Primary Examiner* — Ryan J Walters
*Assistant Examiner* — Joseph Trpisovsky
(74) *Attorney, Agent, or Firm* — Posz Law Group, PLC

(57) ABSTRACT

In an air-conditioning apparatus, an expansion device, a second refrigerant flow switching device, and heat exchangers related to heat medium, connected between the expansion device and the second refrigerant flow switching device such that a heat source side refrigerant flows in parallel, are connected in a part of refrigerant passages, and an expansion device, a second refrigerant flow switching device, and heat exchangers related to heat medium, connected between the expansion device and the second refrigerant flow switching device such that the heat source side refrigerant flows in series, are connected in the rest of the refrigerant passages.

20 Claims, 8 Drawing Sheets

(51) Int. Cl.
*F25D 17/00* (2006.01)
*F25B 30/02* (2006.01)
*F25B 25/00* (2006.01)

(52) U.S. Cl.
CPC ... *F25B 2313/006* (2013.01); *F25B 2313/023* (2013.01); *F25B 2313/0231* (2013.01); *F25B 2313/0272* (2013.01); *F25B 2313/02732* (2013.01); *F25B 2313/02741* (2013.01); *F25B 2500/01* (2013.01)

(58) Field of Classification Search
CPC .... F25B 2313/0272; F25B 2313/02732; F25B 2313/02741; F25B 2313/023
USPC ..... 62/324.6, 175, 180, 335, 525, 526
See application file for complete search history.

(56) References Cited

U.S. PATENT DOCUMENTS

| | | | | |
|---|---|---|---|---|
| 2002/0157417 | A1* | 10/2002 | Iritani et al. | 62/515 |
| 2009/0013700 | A1* | 1/2009 | Unezaki et al. | 62/77 |
| 2011/0011125 | A1* | 1/2011 | Kasahara | 62/498 |
| 2011/0088421 | A1* | 4/2011 | Wakamoto et al. | 62/238.7 |

FOREIGN PATENT DOCUMENTS

| | | | | |
|---|---|---|---|---|
| JP | 05-90267 | U | 12/1993 | |
| JP | 11-037587 | A | 2/1999 | |
| JP | 2001-289465 | A | 10/2001 | |
| JP | 2002-267289 | A | 9/2002 | |
| JP | 2003-063236 | A | 3/2003 | |
| JP | 2003-343936 | A | 12/2003 | |
| JP | 2004-163052 | A | 6/2004 | |
| JP | 2005-140444 | A | 6/2005 | |
| JP | 2009-222246 | A | 10/2009 | |
| JP | 2009-236393 | A | 10/2009 | |
| JP | 2010-076517 | A | 4/2010 | |
| WO | WO 2006057111 | A1 * | 6/2006 | F25B 9/00 |
| WO | 2009/133640 | A1 | 11/2009 | |
| WO | 2010/049998 | A1 | 5/2010 | |
| WO | 2010/050002 | A1 | 5/2010 | |

OTHER PUBLICATIONS

Extended European Search Report issued on Jan. 29, 2014 in the corresponding EP application No. 10857215.7.
Office Action mailed Mar. 4, 2014 issued in the corresponding JP patent application No. 2012-533746 (and English translation).
International Search Report of the International Searching Authority mailed Dec. 28, 2010 for the corresponding international application No. PCT/JP2010/005590 (with English translation).
Office Action mailed Sep. 2, 2014 issued in the corresponding JP patent application No. 2012-533746 (and English translation).

* cited by examiner

AIR-CONDITIONING APPARATUS

CROSS REFERENCE TO RELATED APPLICATIONS

This application is a U.S. national stage application of PCT/JP2010/005590 filed on Sep. 14, 2010, the disclosure of which is incorporated herein by reference.

TECHNICAL FIELD

The present invention relates to an air-conditioning apparatus which is applied to, for example, a multi-air-conditioning apparatus for a building.

BACKGROUND

In an air-conditioning apparatus in related-art, such as a multi-air-conditioning apparatus for a building, a refrigerant is circulated, for example, between an outdoor unit, as a heat source unit disposed outside of a structure and an indoor unit disposed inside of the structure. The refrigerant transfers or removes heat in order to heat or cool air, thus heating or cooling a space to be conditioned with the heated or cooled air. As the refrigerant used in such an air-conditioning apparatus, for example, an HFC (hydrofluorocarbon) refrigerant is often used. An air-conditioning apparatus has also been developed which uses a natural refrigerant, such as carbon dioxide (CO2).

In an air-conditioning apparatus called a chiller, cooling energy or heating energy is produced in a heat source unit disposed outside of a structure. Water, antifreeze, or the like is heated or cooled by a heat exchanger disposed in an outdoor unit, and conveyed to an indoor unit, such as a fan coil unit or a panel heater. And thereby, heating or cooling is performed (refer to Patent Literature 1, for example).

An air-conditioning apparatus called a heat recovery chiller is constituted such that a heat source unit is connected to each indoor unit by four water pipes arranged therebetween and, cooled water and heated water and the like are simultaneously supplied so that cooling or heating can be freely selected in indoor units (refer to Patent Literature 2, for example).

Further, an air-conditioning apparatus has been developed in which a heat exchanger for a primary refrigerant and a secondary refrigerant is disposed near each indoor unit to convey the secondary refrigerant to the indoor units (refer to Patent Literature 3, for example).

Furthermore, an air-conditioning apparatus has also been developed which is constituted such that an outdoor unit is connected to each branch unit including a heat exchanger by two pipes to convey a secondary refrigerant to an indoor unit (refer to Patent Literature 4, for example).

Moreover, air-conditioning apparatuses, such as a multi-air-conditioning apparatus for a building, include an air-conditioning apparatus in which a refrigerant is circulated from an outdoor unit to a relay unit and a heat medium, such as water, is circulated from the relay unit to each indoor unit to reduce conveyance power for the heat medium while circulating the heat medium, such as water, through the indoor unit (refer to Patent Literature 5, for example).

CITATION LIST

Patent Literature

Patent Literature 1: Japanese Unexamined Patent Application Publication No. 2005-140444 (Page 4, FIG. 1, for example)

Patent Literature 2: Japanese Unexamined Patent Application Publication No. 5-280818 (Pages 4 and 5, FIG. 1, for example)

Patent Literature 3: Japanese Unexamined Patent Application Publication No. 2001-289465 (Pages 5 to 8, FIGS. 1 and 2, for example)

Patent Literature 4: Japanese Unexamined Patent Application Publication No. 2003-343936 (Page 5, FIG. 1)

Patent Literature 5: WO10/049,998 (Page 3, FIG. 1, for example)

SUMMARY

Technical Problem

In an air-conditioning apparatus in related art, such as a multi-air-conditioning apparatus for a building, a refrigerant may leak into, for example, an indoor space because the refrigerant is circulated up to an indoor unit. On the other hand, in an air-conditioning apparatus like those disclosed in Patent Literature 1 and Patent Literature 2, a refrigerant does not pass through an indoor unit. It is however necessary to heat or cool a heat medium in a heat source unit disposed outside of a structure and convey it to the indoor unit in the air-conditioning apparatus like those disclosed in Patent Literature 1 and Patent Literature 2. Accordingly, the circulation path for the heat medium becomes long. In this case, in conveying heat for predetermined heating or cooling using the heat medium, the amount of energy consumed as conveyance power and the like by the heat medium is higher than that by the refrigerant. As the circulation path becomes longer, therefore, the conveyance power markedly increases. This indicates that energy can be saved as long as the circulation of the heat medium can be properly controlled in the air-conditioning apparatus.

In an air-conditioning apparatus like that disclosed in Patent Literature 2, four pipes have to be connected between an outdoor side and each indoor space so that cooling or heating can be selected in each indoor unit. Disadvantageously, it is far from easy to install this apparatus. In the air-conditioning apparatus disclosed in Patent Literature 3, secondary medium circulating means, such as a pump, has to be provided for each indoor unit. Disadvantageously, the system is costly and the noise is loud, therefore, this apparatus is not practical. In addition, since the heat exchanger is placed near each indoor unit, there always remains the risk that the refrigerant may be leak into a place near the indoor space.

In an air-conditioning apparatus like that disclosed in Patent Literature 4, a primary refrigerant subjected to heat exchange flows into the same passage as that for the primary refrigerant to be subjected to heat exchange. In such a case, when a plurality of indoor units are connected, it is difficult for each indoor unit to exhibit a maximum capacity. Such a configuration wastes energy. Furthermore, each branch unit is connected to an extension pipe by two pipes for cooling and two pipes for heating, namely, four pipes in total. Consequently, this configuration is similar to that of a system in which the outdoor unit is connected to each branch unit by four pipes. Accordingly, it is far from easy to install this apparatus.

In an air-conditioning apparatus like that disclosed in Patent Literature 5, the pressure of a refrigerant while an evaporator is operating is lower than that while a condenser is operating. The density of the refrigerant while the evaporator is operating is therefore lower than that while the condenser is operating. In comparison between the use of a heat exchanger, between the refrigerant and the heat medium, as a condenser and the use thereof as an evaporator with respect to the same area of refrigerant passage, when the area of the passage is reduced, pressure loss in the refrigerant passage in the use as an evaporator becomes too large. On the other hand, when the area of the passage is increased, the heat exchange efficiency of the heat exchanger, between the refrigerant and the heat medium, used as a condenser is reduced. In other words, it is difficult to perform an operation such that energy efficiency is optimized at all times.

The present invention has been made to overcome the above problems and aims to provide an air-conditioning apparatus that is capable of saving energy. Some aspects of the present invention provide an air-conditioning apparatus that can improve safety without circulating a refrigerant in or near an indoor unit. Some aspects of the present invention provide an air-conditioning apparatus that includes a reduced number of pipes connecting an outdoor unit and a branching unit (heat medium relay unit) or an indoor unit to make the installation easier and improve energy efficiency. Some aspects of the present invention provide an air-conditioning apparatus that is capable of improving heat exchange efficiency while achieving miniaturization of a heat exchanger related to heat medium.

Solution to Problem

The present invention provides an air-conditioning apparatus including a refrigerant circuit in which a compressor, a first refrigerant flow switching device, a heat source side heat exchanger, a plurality of expansion devices, refrigerant passages of a plurality of heat exchangers related to heat medium, and a plurality of second refrigerant flow switching devices are connected by refrigerant pipes to circulate a heat source side refrigerant, and a heat medium circuit in which a pump, a use side heat exchanger, heat medium side passages of the plurality of heat exchangers related to heat medium, a heat medium flow control device disposed on an inlet side or an outlet side of the use side heat exchanger, and heat medium flow switching devices arranged on the inlet side and the outlet side of the use side heat exchanger are connected by heat medium pipes to circulate a heat medium. In the air-conditioning apparatus, the plurality of heat exchangers related to heat medium exchange heat between the heat source side refrigerant and the heat medium, and the refrigerant circuit branches into a plurality of refrigerant passages. Further, a part of the refrigerant passages each connect the corresponding expansion device, the corresponding second refrigerant flow switching device, and a first heat exchanger related to heat medium connected between the expansion device and the second refrigerant flow switching device and the rest of the refrigerant passages each connect the corresponding expansion device, the corresponding second refrigerant flow switching device, a second heat exchanger related to heat medium connected between the expansion device and the second refrigerant flow switching device, and the air-conditioning apparatus is configured such that pressure loss in a refrigerant passage of the second heat exchanger related to heat medium is larger than pressure loss in a refrigerant passage of the first heat exchanger related to heat medium when the flow rate of the refrigerant of the refrigerant passage of the first heat exchanger related to heat medium is substantially the same as the flow rate of the refrigerant passage of the second heat exchanger related to heat medium, and the refrigerant passage of the second heat exchanger related to heat medium has a longer passage length in a flow direction than the refrigerant passage of the first heat exchanger related to heat medium.

Since the air-conditioning apparatus according to the present invention requires less conveyance power because pipes through which the heat medium circulates can be shortened, the apparatus can save energy. In addition, even if the heat medium leaks to the outside of the air-conditioning apparatus according to the present invention, the amount of the leakage can be kept small. Accordingly, the safety can be improved. Furthermore, the air-conditioning apparatus according to the present invention can be installed more easily. Moreover, the air-conditioning apparatus according to the present invention can improve the heat exchange efficiency in the heat exchangers related to heat medium while achieving a low profile of the heat exchangers related to heat medium, thus energy can be saved.

DETAILED DESCRIPTION

Embodiment of the present invention will be described below with reference to the drawings.

Figure 1:
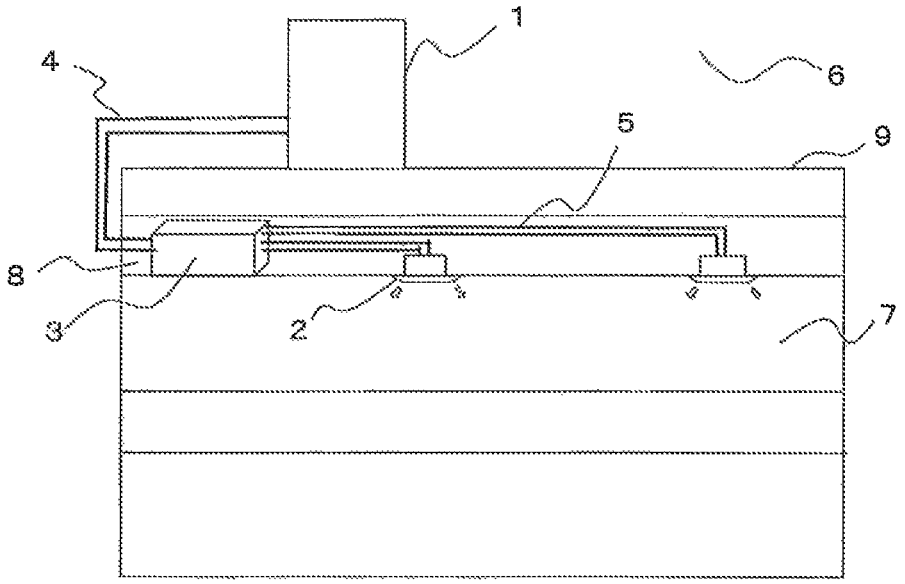
FIG. 1 is a schematic diagram illustrating an example of installation of an air-conditioning apparatus according to Embodiment of the present invention.
Figure 2:
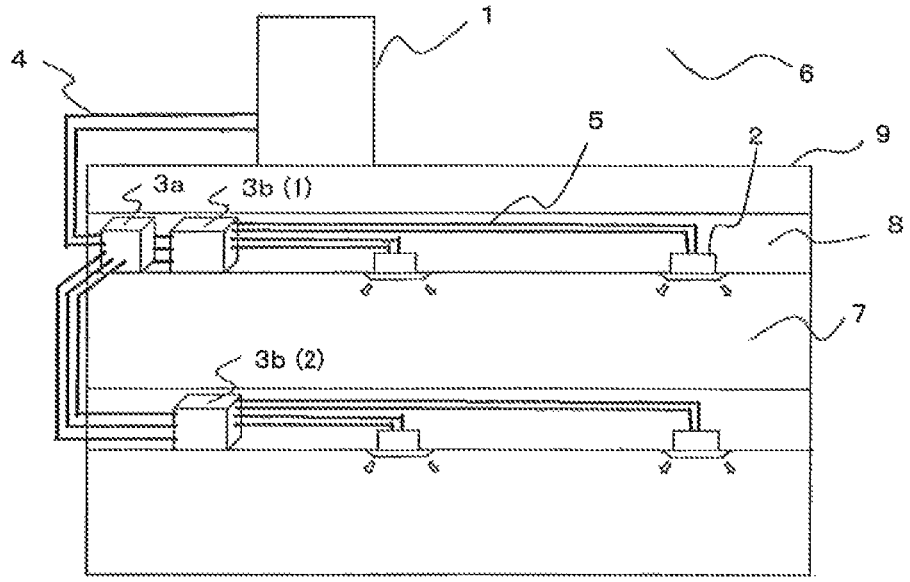
FIG. 2 is a schematic diagram illustrating another example of installation of the air-conditioning apparatus according to Embodiment of the present invention.

FIGS. 1 and 2 are schematic diagrams illustrating examples of installation of an air-conditioning apparatus according to Embodiment of the present invention. The examples of installation of the air-conditioning apparatus will be described with reference to FIGS. 1 and 2. This air-conditioning apparatus uses refrigeration cycles (a refrigerant circuit A and a heat medium circuit B), through each of which a refrigerant (a heat source side refrigerant or a heat medium) is circulated, to permit each indoor unit to freely select a cooling mode or a heating mode. Note that the dimensional relationship among components in FIG. 1 and the other figures may be different from the actual one.

Referring to FIG. 1, the air-conditioning apparatus according to Embodiment includes a single outdoor unit 1, functioning as a heat source unit, a plurality of indoor units 2, and a heat medium relay unit 3 disposed between the outdoor unit 1 and the indoor units 2. The heat medium relay unit 3 is configured to exchange heat between the heat source side refrigerant and the heat medium. The outdoor unit 1 is connected to the heat medium relay unit 3 by refrigerant pipes 4 through which the heat source side refrigerant is conveyed. The heat medium relay unit 3 is connected to each indoor unit 2 by pipes (heat medium pipes) 5 through which the heat medium is conveyed. Cooling energy or heating energy produced in the outdoor unit 1 is delivered through the heat medium relay unit 3 to the indoor units 2.

Referring to FIG. 2, the air-conditioning apparatus according to Embodiment includes a single outdoor unit 1, a plurality of indoor units 2, and a plurality of separated heat medium relay units 3 (a main heat medium relay unit 3*a* and sub heat medium relay units 3*b*) arranged between the outdoor unit 1 and the indoor units 2. The outdoor unit 1 is connected to the main heat medium relay unit 3*a* by the refrigerant pipes 4. The main heat medium relay unit 3*a* is connected to the sub heat medium relay units 3*b* by the refrigerant pipes 4. Each of the sub heat medium relay units 3*b* is connected to each indoor unit 2 by the pipes 5. Cooling energy or heating energy produced in the outdoor unit 1 is delivered through the main heat medium relay unit 3*a* and the sub heat medium relay units 3*b* to the indoor units 2.

The outdoor unit 1, typically disposed in an outdoor space 6 which is a space (e.g., a roof) outside of a structure 9, such as a building, is configured to supply cooling energy or heating energy through the heat medium relay unit 3 to the indoor units 2. Each indoor unit 2 is disposed at a position such that it can supply cooling air or heating air to an indoor space 7, which is a space (e.g., a living room) inside of the structure 9, and is configured to supply the cooling air or heating air to the indoor space 7, as a space to be conditioned. The heat medium relay unit 3 is configured so as to include a housing separated from housings of the outdoor unit 1 and the indoor units 2 such that the heat medium relay unit 3 can be disposed at a position different from those of the outdoor space 6 and the indoor space 7, and is connected to the outdoor unit 1 through the refrigerant pipes 4 and is connected to the indoor units 2 through the pipes 5 to transfer cooling energy or heating energy, supplied from the outdoor unit 1, to the indoor units 2.

As illustrated in FIGS. 1 and 2, in the air-conditioning apparatus according to Embodiment, the outdoor unit 1 is connected to the heat medium relay unit 3 using two refrigerant pipes 4 and the heat medium relay unit 3 is connected to each indoor unit 2 using two pipes 5. As described above, in the air-conditioning apparatus according to Embodiment, each of the units (the outdoor unit 1, the indoor units 2, and the heat medium relay unit 3) is connected using two pipes (the refrigerant pipes 4 or the pipes 5), thus facilitating the construction.

As illustrated in FIG. 2, the heat medium relay unit 3 can be separated into a single main heat medium relay unit 3*a* and two sub heat medium relay units 3*b* (a sub heat medium relay unit 3*b*(1) and a sub heat medium relay unit 3*b*(2)) branched off from the main heat medium relay unit 3*a*. This separation allows a plurality of sub heat medium relay units 3*b* to be connected to the single main heat medium relay unit 3*a*. In this configuration, the main heat medium relay unit 3*a* is connected to each sub heat medium relay unit 3*b* by three refrigerant pipes 4. Such a circuit will be described in detail later (refer to FIG. 4).

FIGS. 1 and 2 illustrate a state where each heat medium relay unit 3 is disposed in a space different from the indoor space 7, for example, a space above a ceiling (hereinafter, simply referred to as a "space 8") inside of the structure 9. The heat medium relay unit 3 can be placed in another space, for example, a common space where an elevator or the like is installed. Furthermore, although FIGS. 1 and 2 illustrate a case where the indoor units 2 are of a ceiling cassette type, the indoor units are not limited to this type and may be of any type, such as a ceiling concealed type or a ceiling suspended type, as long as the indoor units 2 are capable of blowing out heating air or cooling air into the indoor space 7 directly or through a duct or the like.

Although FIGS. 1 and 2 illustrate the case where the outdoor unit 1 is disposed in the outdoor space 6, the arrangement is not limited to this case. For example, the outdoor unit 1 may be disposed in an enclosed space, for example, a machine room with a ventilation opening, may be disposed inside of the structure 9 as long as waste heat can be exhausted through an exhaust duct to the outside of the structure 9, or may be disposed inside of the structure 9 in the use of the outdoor unit 1 of a water-cooled type. There is no particular problem when the outdoor unit 1 is disposed in such a place.

Furthermore, the heat medium relay unit 3 can be disposed near the outdoor unit 1. If the distance between the heat medium relay unit 3 and each indoor unit 2 is too long, the conveyance power for the heat medium becomes considerably large. It should be therefore noted that the energy saving effect is reduced in this case. In addition, the number of outdoor units 1, the number of indoor units 2, and the number of heat medium relay units 3 which are connected are not limited to the numbers illustrated in FIGS. 1 and 2. The numbers may be determined depending on the structure 9 where the air-conditioning apparatus according to Embodiment is installed.

Figure 3:
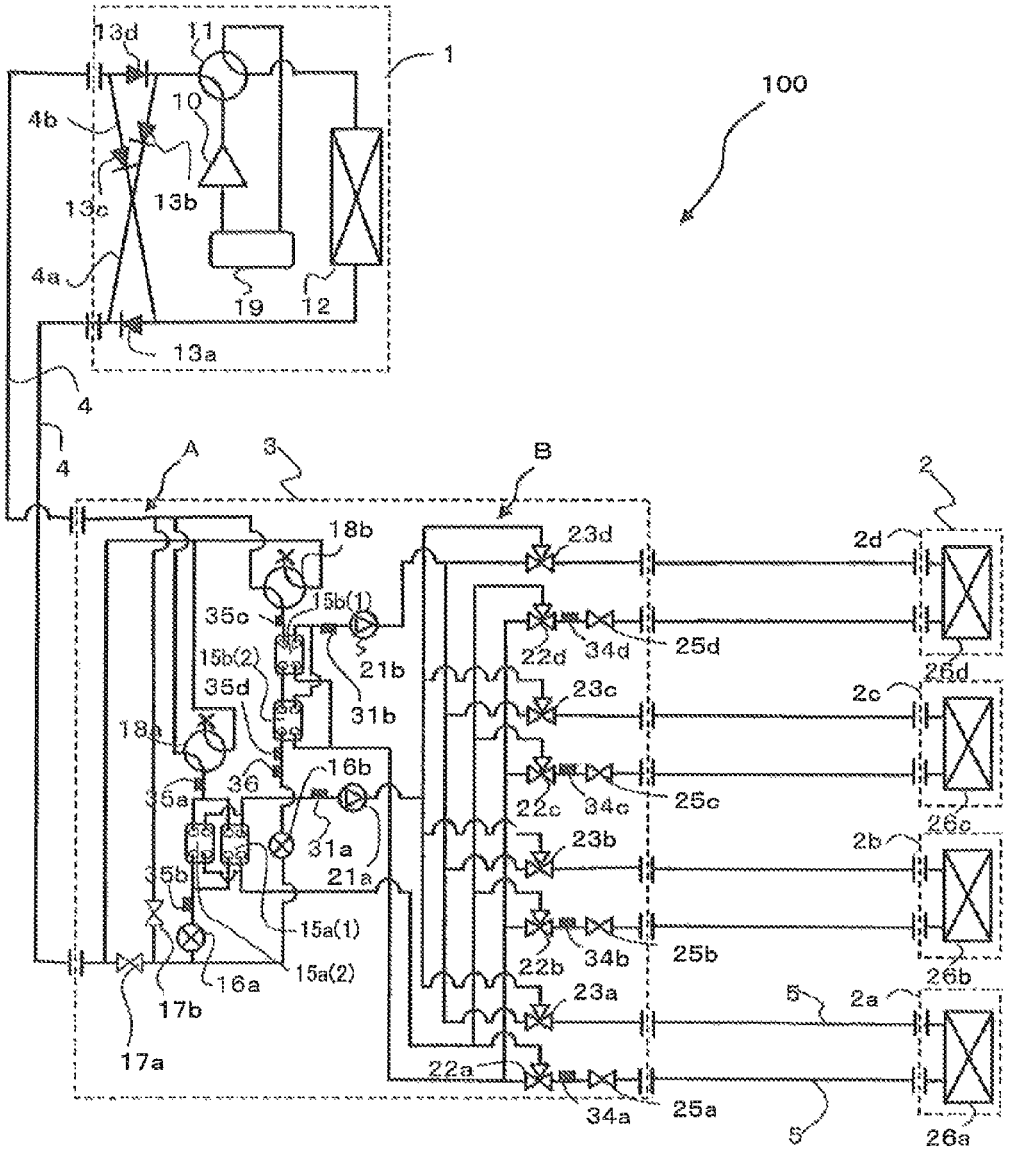
FIG. 3 is a schematic configuration diagram illustrating an exemplary circuit configuration of the air-conditioning apparatus according to Embodiment of the present invention.

FIG. 3 is a schematic configuration diagram illustrating an exemplary circuit configuration of the air-conditioning apparatus (hereinafter, referred to as an "air-conditioning apparatus 100") according to Embodiment. The detailed configuration of the air-conditioning apparatus 100 will be described with reference to FIG. 3. Referring to FIG. 3, the outdoor unit 1 and the heat medium relay unit 3 are connected by the refrigerant pipes 4 through heat exchangers related to heat medium 15*a* (a heat exchanger related to heat medium 15*a*(1) and a heat exchanger related to heat medium 15*a*(2)) and heat exchangers related to heat medium 15*b* (a heat exchanger related to heat medium 15*b*(1) and a heat exchanger related to heat medium 15*b*(2)) which are arranged in the heat medium relay unit 3. Furthermore, the heat medium relay unit 3 and each indoor unit 2 are also connected by the pipes 5 through the heat exchangers related to heat medium 15*a* and the heat exchangers related to heat medium 15*b*.

Note that in the following description, the heat exchangers related to heat medium 15*a* include both the heat exchanger related to heat medium 15*a*(1) and the heat exchanger related to heat medium 15*a*(2). Similarly, in the following description, the heat exchangers related to heat medium 15*b* include both the heat exchanger related to heat medium 15*b*(1) and the heat exchanger related to heat medium 15*b*(2). The refrigerant pipes 4 will be described in detail later.

[Outdoor Unit 1]

The outdoor unit 1 includes a compressor 10, a first refrigerant flow switching device 11, such as a four-way valve, a heat source side heat exchanger 12, and an accumulator 19 which are connected in series by the refrigerant pipes 4. The outdoor unit 1 further includes a first connecting pipe 4*a*, a second connecting pipe 4*b*, a check valve 13*a*, a check valve 13*b*, a check valve 13*c*, and a check valve 13*d*. Such an arrangement of the first connecting pipe 4*a*, the second connecting pipe 4*b*, the check valve 13*a*, the check valve 13*b*, the check valve 13*c*, and the check valve 13*d* enables the heat source side refrigerant, allowed to flow into the heat medium relay unit 3, to flow in a constant direction irrespective of an operation requested by any indoor unit 2.

The compressor 10 is configured to suction the heat source side refrigerant and compress the heat source side refrigerant to a high-temperature, high-pressure state, and may be a capacity-controllable inverter compressor, for example. The first refrigerant flow switching device 11 is configured to switch the direction between a flow of the heat source side refrigerant during a heating operation (including a heating only operation mode and a heating main operation mode) and a flow of the heat source side refrigerant during a cooling operation (including a cooling only operation mode and a cooling main operation mode).

The heat source side heat exchanger 12 is configured to function as an evaporator in the heating operation, function as a condenser (or a radiator) in the cooling operation, exchange heat between air, supplied from an air-sending device, such as a fan (not illustrated), and the heat source side refrigerant, and evaporate and gasify or condense and liquefy the heat source side refrigerant. The accumulator 19 is disposed on a suction side of the compressor 10 and is configured to store an excess refrigerant caused by the difference between the heating operation and the cooling operation or by transient change in operation.

The check valve 13*d* is disposed in the refrigerant pipe 4 positioned between the heat medium relay unit 3 and the first refrigerant flow switching device 11 and is configured to permit the heat source side refrigerant to flow only in a predetermined direction (the direction from the heat medium relay unit 3 to the outdoor unit 1). The check valve 13*a* is disposed in the refrigerant pipe 4 positioned between the heat source side heat exchanger 12 and the heat medium relay unit 3 and is configured to permit the heat source side refrigerant to flow only in a predetermined direction (the direction from the outdoor unit 1 to the heat medium relay unit 3). The check valve 13*b* is disposed in the first connecting pipe 4*a* and is configured to allow the heat source side refrigerant, discharged from the compressor 10 in the heating operation, to flow to the heat medium relay unit 3. The check valve 13*c* is disposed in the second connecting pipe 4*b* and is configured to allow the heat source side refrigerant, returned from the heat medium relay unit 3 in the heating operation, to flow to the suction side of the compressor 10.

The first connecting pipe 4*a* is configured to connect the refrigerant pipe 4, positioned between the first refrigerant flow switching device 11 and the check valve 13*d*, to the refrigerant pipe 4, positioned between the check valve 13*a* and the heat medium relay unit 3, in the outdoor unit 1. The second connecting pipe 4*b* is configured to connect the refrigerant pipe 4, positioned between the check valve 13*d* and the heat medium relay unit 3, to the refrigerant pipe 4, positioned between the heat source side heat exchanger 12 and the check valve 13*a*, in the outdoor unit 1. Furthermore, although FIG. 3 illustrates a case where the first connecting pipe 4*a*, the second connecting pipe 4*b*, the check valve 13*a*, the check valve 13*b*, the check valve 13*c*, and the check valve 13*d* are arranged, the arrangement is not limited to this case. It is not necessary to arrange these components.

[Indoor Units 2]

The indoor units 2 each include a use side heat exchanger 26. This use side heat exchanger 26 is connected by the pipes 5 to a heat medium flow control device 25 and a second heat medium flow switching device 23 arranged in the heat medium relay unit 3. This use side heat exchanger 26 is configured to exchange heat between air supplied from an air-sending device, such as a fan (not illustrated), and the heat medium in order to produce heating air or cooling air to be supplied to the indoor space 7.

FIG. 3 illustrates a case where four indoor units 2 are connected to the heat medium relay unit 3. An indoor unit 2*a*, an indoor unit 2*b*, an indoor unit 2*c*, and an indoor unit 2*d* are illustrated in that order from the bottom of the drawing sheet. In addition, the use side heat exchangers 26 are illustrated as a use side heat exchanger 26*a*, a use side heat exchanger 26*b*, a use side heat exchanger 26*c*, and a use side heat exchanger 26*d* in that order from the bottom of the drawing sheet so as to correspond to the indoor units 2*a* to 2*d*, respectively. Note that the number of indoor units 2 connected is not limited to four as illustrated in FIG. 3 in a manner similar to the cases in FIGS. 1 and 2.

[Heat Medium Relay Unit 3]

The heat medium relay unit 3 includes the four heat exchangers related to heat medium 15, two expansion devices 16, two opening and closing devices 17, two second refrigerant flow switching devices 18, two pumps 21, four first heat medium flow switching devices 22, the four second heat medium flow switching devices 23, and the four heat medium flow control devices 25. Furthermore, a configuration in which the heat medium relay unit 3 is separated into the main heat medium relay unit 3*a* and the sub heat medium relay unit 3*b* will be described later with reference to FIG. 4.

Each of the four heat exchangers related to heat medium 15 (the heat exchangers related to heat medium 15*a* and the heat exchangers related to heat medium 15*b*) is configured to function as a condenser (radiator) or an evaporator and exchange heat between the heat source side refrigerant and the heat medium in order to transfer cooling energy or heating energy, produced by the outdoor unit 1 and stored in the heat source side refrigerant, to the heat medium. The heat exchangers related to heat medium 15*a* are arranged between an expansion device 16*a* and a second refrigerant flow switching device 18*a* in the refrigerant circuit A and is used to cool the heat medium in a cooling and heating mixed operation mode. Furthermore, the heat exchangers related to heat medium 15*b* are arranged between an expansion device 16*b* and a second refrigerant flow switching device 18*b* in the refrigerant circuit A and is used to heat the heat medium in the cooling and heating mixed operation mode.

The space 8 where the heat medium relay unit 3 including the heat exchangers related to heat medium 15 is often installed is positioned in a space, for example, above a ceiling and is therefore often restricted in height as compared to the outdoor space 6 or the indoor space 7. The heat medium relay unit 3 therefore has to be made more compact. To reduce the height or profile of the heat medium relay unit 3, a plate heat exchanger with a low profile is often used as each of the heat exchangers related to heat medium 15 arranged in the heat medium relay unit 3. In this case, since each heat exchanger has a low capacity, a plurality of heat exchangers are arranged in parallel to provide heat quantity.

In this arrangement, however, especially when the heat exchangers are used as condensers, the flow velocity of the heat source side refrigerant in the plate heat exchangers is lowered. This results in a reduction in heat transfer performance. On the other hand, in the case where the heat exchangers are arranged in series, especially when the heat exchangers are used as evaporators, pressure loss becomes too large. Such an arrangement cannot be adopted. The way of connecting the heat exchangers related to heat medium 15 is therefore improved as follows.

The heat exchangers related to heat medium 15*a* are connected such that the heat source side refrigerant flows in parallel through the heat exchanger related to heat medium 15*a*(1) and the heat exchanger related to heat medium 15*a*(2). On the other hand, the heat exchangers related to heat medium 15*b* are connected such that the heat source side refrigerant flows in series through the heat exchanger related to heat medium 15*b*(1) and the heat exchanger related to heat medium 15*b*(2). As will be described later, in the cooling and heating mixed operation mode, a high-temperature, high-pressure heat source side refrigerant flows through the second refrigerant flow switching device 18*b*, the heat exchanger related to heat medium 15*b*(1), the heat exchanger related to heat medium 15*b*(2), and the expansion device 16*b*, in which the heat source side refrigerant is expanded to a low-temperature, low-pressure refrigerant, and the heat source side refrigerant flows through the expansion device 16*a*, the heat exchanger related to heat medium 15*a*(1), the heat exchanger related to heat medium 15*a*(2), and the second refrigerant flow switching device 18*a* in that order.

As the flow velocity of the heat source side refrigerant in the heat exchangers related to heat medium 15 is higher, the heat transfer coefficient of the heat source side refrigerant is higher. Thus, the heat exchange performance between the heat source side refrigerant and the heat medium is increased. As the flow velocity of the heat source side refrigerant in the heat exchangers related to heat medium 15 is higher, however, pressure loss of the heat source side refrigerant is larger. In particular, when a large pressure loss occurs on a low-pressure side, performance is significantly reduced. Note that as the density of the heat source side refrigerant is lower, the pressure loss of the heat source side refrigerant is larger.

A high-temperature, high-pressure heat source side refrigerant has high density, whereas a low-temperature, low-pressure heat source side refrigerant has low density. It is therefore preferable that the flow velocity of the heat source side refrigerant in the heat exchanger related to heat medium 15*b*(1) and the heat exchanger related to heat medium 15*b*(2), through which a high-temperature, high-pressure heat source side refrigerant flows in the cooling and heating mixed operation mode to heat the heat medium, should be increased to improve the heat exchange performance. Furthermore, it is preferable that the flow velocity of the heat source side refrigerant in the heat exchanger related to heat medium 15*a*(1) and the heat exchanger related to heat medium 15*a*(2), through which a low-temperature, low-pressure refrigerant flows in the cooling and heating mixed operation mode to cool the heat medium, should be reduced to reduce pressure loss in order to improve the efficiency of the refrigeration cycle.

The heat exchanger related to heat medium 15*b*(1) and the heat exchanger related to heat medium 15*b*(2) are therefore arranged such that the heat source side refrigerant flows through them in series. Consequently, the flow velocity of the heat source side refrigerant in the heat exchanger related to heat medium 15*b*(1) and the heat exchanger related to heat medium 15*b*(2) is increased, thus the heat exchange efficiency is improved. At this time, since the heat source side refrigerant has a high pressure, the density of the heat source side refrigerant is high. Pressure loss of the heat source side refrigerant is not so large. Furthermore, the heat exchanger related to heat medium 15*a*(1) and the heat exchanger related to heat medium 15*a*(2) are arranged such that the heat source side refrigerant flows through them in parallel. Consequently, although the flow velocity of the heat source side refrigerant is reduced such that the heat exchange efficiency is reduced to some extent, an increase in the area of the passage for the heat source side refrigerant in the heat exchangers related to heat medium 15 prevents an increase in refrigerant pressure loss even when a low-pressure, low-density refrigerant flows through the heat exchangers related to heat medium 15.

Such an arrangement improves the efficiency of the entire refrigeration cycle while miniaturizing the heat medium relay unit 3, that is, profile of the heat exchangers related to heat medium 15 is reduced, thus providing a high energy efficiency system. Note that the connection is made such that the heat medium flows in parallel into the heat exchanger related to heat medium 15*a*(1), the heat exchanger related to heat medium 15*a*(2), the heat exchanger related to heat medium 15*b*(1), and the heat exchanger related to heat medium 15*b*(2) as illustrated in FIG. 3.

The two expansion devices 16 (the expansion device 16*a* and the expansion device 16*b*) each have functions of a reducing valve and an expansion valve and are configured to reduce the pressure of the heat source side refrigerant in order to expand it. The expansion device 16*a* is disposed upstream from the heat exchangers related to heat medium 15*a* in the flow direction of the heat source side refrigerant during the cooling operation. The expansion device 16*b* is disposed upstream from the heat exchangers related to heat medium 15*b* in the flow direction of the heat source side refrigerant during the cooling operation. Each of the two expansion devices 16 may be a component having a variably controllable opening degree, for example, an electronic expansion valve.

The two opening and closing devices 17 (an opening and closing device 17*a* and an opening and closing device 17*b*) each include a two-way valve and are configured to open or close the refrigerant pipe 4. The opening and closing device 17*a* is disposed in the refrigerant pipe 4 on an inlet side for the heat source side refrigerant. The opening and closing device 17*b* is disposed in a pipe connecting the refrigerant pipe 4 on the inlet side for the heat source side refrigerant and the refrigerant pipe 4 on an outlet side therefor.

The two second refrigerant flow switching devices 18 (the second refrigerant flow switching device 18*a* and the second refrigerant flow switching device 18*b*) each include a four-way valve, for example, and are configured to switch the flow direction of the heat source side refrigerant in accordance with an operation mode. The second refrigerant flow switching device 18*a* is disposed downstream from the heat exchangers related to heat medium 15*a* in the flow direction of the heat source side refrigerant during the cooling operation. The second refrigerant flow switching device 18*b* is disposed downstream from the heat exchangers related to heat medium 15*b* in the flow direction of the heat source side refrigerant in the cooling only operation mode.

The two pumps 21 (a pump 21*a* and a pump 21*b*) are configured to circulate the heat medium conveyed through the pipes 5. The pump 21*a* is disposed in the pipe 5 positioned between heat exchangers related to heat medium 15*a* and the second heat medium flow switching devices 23. The pump 21*b* is disposed in the pipe 5 positioned between heat exchangers related to heat medium 15*b* and the second heat medium flow switching devices 23. Each of the two pumps 21 may be, for example, a capacity-controllable pump such that a flow rate in the pump can be controlled in accordance with the magnitude of loads in the indoor units 2.

The four first heat medium flow switching devices 22 (first heat medium flow switching devices 22*a* to 22*d*), each serving as one of heat medium flow switching devices, each include a three-way valve, for example, and are configured to switch the heat medium passage. The first heat medium flow switching devices 22 whose number (four in this case) corresponds to the number of indoor units 2 installed are arranged. Each first heat medium flow switching device 22 is disposed on an outlet side of a heat medium passage of the corresponding use side heat exchanger 26 such that one of the three ways is connected to the heat exchangers related to heat medium 15*a*, another one of the three ways is connected to the heat exchangers related to heat medium 15*b*, and the other one of the three ways is connected to the heat medium flow control device 25.

Note that the first heat medium flow switching device 22*a*, the first heat medium flow switching device 22*b*, the first heat medium flow switching device 22*c*, and the first heat medium flow switching device 22*d* are illustrated in that order from the bottom of the drawing sheet so as to correspond to the indoor units 2. Furthermore, switching the heat medium flow includes not only complete switching from one to another but also partial switching from one to another.

The four second heat medium flow switching devices 23 (second heat medium flow switching devices 23*a* to 23*d*), each serving as one of heat medium flow switching devices, each include a three-way valve, for example, and are configured to switch the heat medium passage. The second heat medium flow switching devices 23 whose number (four in this case) corresponds to the number of indoor units 2 installed are arranged. Each second heat medium flow switching device 23 is disposed on an inlet side of a heat medium passage of the corresponding use side heat exchanger 26 such that one of the three ways is connected to the heat exchangers related to heat medium 15*a*, another one of the three ways is connected to the heat exchangers related to heat medium 15*b*, and the other one of the three ways is connected to the use side heat exchanger 26.

Note that the second heat medium flow switching device 23*a*, the second heat medium flow switching device 23*b*, the second heat medium flow switching device 23*c*, and the second heat medium flow switching device 23*d* are illustrated in that order from the bottom of the drawing sheet so as to correspond to the indoor units 2. Furthermore, switching the heat medium passage includes not only complete switching from one to another but also partial switching from one to another.

The four heat medium flow control devices 25 (heat medium flow control devices 25*a* to 25*d*) each include a two-way valve capable of controlling the area of an opening and are configured to control a flow rate of the heat medium flowing through the pipe 5. The heat medium flow control devices 25 whose number (four in this case) corresponds to the number of indoor units 2 installed are arranged. Each heat medium flow control device 25 is disposed on the outlet side of the heat medium passage of the corresponding use side heat exchanger 26 such that one way is connected to the use side heat exchanger 26 and the other way is connected to the first heat medium flow switching device 22. In other words, each heat medium flow control device 25 is configured to control the rate of the heat medium flowing into indoor unit 2 in accordance with the temperature of the heat medium flowing into the indoor unit 2 and the temperature of the heat medium flowing therefrom such that an optimum rate of heat medium based on an indoor load can be provided to the indoor unit 2.

Note that the heat medium flow control device 25*a*, the heat medium flow control device 25*b*, the heat medium flow control device 25*c*, and the heat medium flow control device 25*d* are illustrated in that order from the bottom of the drawing sheet so as to correspond to the indoor units 2. Further, each heat medium flow control device 25 may be disposed on the inlet side of the heat medium passage of the corresponding use side heat exchanger 26. Furthermore, the heat medium flow control device 25 may be disposed on the inlet side of the heat medium passage of the use side heat exchanger 26 such that the heat medium flow control device 25 is positioned between the second heat medium flow switching device 23 and the use side heat exchanger 26. Moreover, while any load is not needed in the indoor unit 2, for example, during suspension or in thermo-off state, fully closing the heat medium flow control device 25 can stop supply of the heat medium to the indoor unit 2.

The heat medium relay unit 3 further includes various detecting means (two first temperature sensors 31, four second temperature sensors 34, four third temperature sensors 35, and a pressure sensor 36). Information (temperature information and pressure information) detected by these detecting means are transmitted to a controller (not illustrated) that performs integrated control of operations of the air-conditioning apparatus 100 such that the information is used to control, for example, a driving frequency of the compressor 10, a rotation speed of each air-sending device (not illustrated), switching by the first refrigerant flow switching device 11, a driving frequency of the pumps 21, switching by the second refrigerant flow switching devices 18, and switching the heat medium passage, and a flow rate of the heat medium in each indoor unit 2.

Each of the two first temperature sensors 31 (a first temperature sensor 31*a* and a first temperature sensor 31*b*) is configured to detect the temperature of the heat medium flowing from the heat exchangers related to heat medium 15, namely, the heat medium on the outlet side of the heat exchangers related to heat medium 15 and may be a thermistor, for example. The first temperature sensor 31*a* is disposed in the pipe 5 on an inlet side of the pump 21*a*. The first temperature sensor 31*b* is disposed in the pipe 5 on an inlet side of the pump 21*b*.

Each of the four second temperature sensors 34 (second temperature sensors 34*a* to 34*d*) is disposed between the first heat medium flow switching device 22 and the heat medium flow control device 25 and is configured to detect the temperature of the heat medium flowing out of the use side heat exchanger 26 and may be a thermistor, for example. The second temperature sensors 34 whose number (four in this case) corresponds to the number of indoor units 2 installed are arranged. Note that the second temperature sensor 34*a*, the second temperature sensor 34*b*, the second temperature sensor 34*c*, and the second temperature sensor 34*d* are illustrated in that order from the bottom of the drawing sheet so as to correspond to the indoor units 2. Furthermore, each second temperature sensor 34 may be disposed in a passage between the heat medium flow control device 25 and the use side heat exchanger 26.

Each of the four third temperature sensors 35 (third temperature sensors 35*a* to 35*d*) is disposed on a heat source side refrigerant inlet or outlet side of the heat exchangers related to heat medium 15 and is configured to detect the temperature of the heat source side refrigerant flowing into the heat exchangers related to heat medium 15, or the temperature of the heat source side refrigerant flowing from the heat exchangers related to heat medium 15 and may be a thermistor, for example. The third temperature sensor 35*a* is disposed between the heat exchangers related to heat medium 15*a* and the second refrigerant flow switching device 18*a*. The third temperature sensor 35*b* is disposed between the heat exchangers related to heat medium 15*a* and the expansion device 16*a*. The third temperature sensor 35*c* is disposed between the heat exchangers related to heat medium 15*b* and the second refrigerant flow switching device 18*b*. The third temperature sensor 35*d* is disposed between the heat exchangers related to heat medium 15*b* and the expansion device 16*b*.

The pressure sensor 36 is disposed between the heat exchangers related to heat medium 15*b* and the expansion device 16*b*, similar to the installed position of the third temperature sensor 35*d*, and is configured to detect the pressure of the heat source side refrigerant flowing between the heat exchangers related to heat medium 15*b* and the expansion device 16*b*.

Furthermore, the controller (not illustrated) includes a microcomputer and the like and controls, for example, the driving frequency of the compressor 10, the rotation speed (including ON/OFF) of each air-sending device, switching by the first refrigerant flow switching device 11, driving of the pumps 21, the opening degree of each expansion device 16, opening and closing of each opening and closing device 17, switching by the second refrigerant flow switching devices 18, switching by the first heat medium flow switching devices 22, switching by the second heat medium flow switching devices 23, and driving of the heat medium flow control devices 25 on the basis of the information detected by the various detecting means and instructions from a remote control in order to carry out any of the operation modes which will be described later. Note that the controller may be provided for each unit or may be provided for the outdoor unit 1 or the heat medium relay unit 3.

The pipes 5 for conveying the heat medium include the pipes connected to the heat exchangers related to heat medium 15*a* and the pipes connected to the heat exchangers related to heat medium 15*b*. Each pipe 5 branches (into four pipes in this case) in accordance with the number of indoor units 2 connected to the heat medium relay unit 3. The pipes 5 are connected via the first heat medium flow switching devices 22 and the second heat medium flow switching devices 23. Controlling each first heat medium flow switching device 22 and each second heat medium flow switching device 23 determines whether the heat medium flowing from the heat exchangers related to heat medium 15*a* is allowed to flow into the corresponding use side heat exchanger 26 and whether the heat medium flowing from the heat exchangers related to heat medium 15*b* is allowed to flow into the corresponding use side heat exchanger 26.

In the air-conditioning apparatus 100, the compressor 10, the first refrigerant flow switching device 11, the heat source side heat exchanger 12, the opening and closing devices 17, the second refrigerant flow switching devices 18, refrigerant passages of the heat exchangers related to heat medium 15, the expansion devices 16, and the accumulator 19 are connected by the refrigerant pipes 4, thus forming the refrigerant circuit A (in which the expansion device 16*a*, the heat exchangers related to heat medium 15*a*, and the second refrigerant flow switching device 18*a* constitute one of a plurality of refrigerant passages constituting the refrigerant circuit A, and the expansion device 16*b*, the heat exchangers related to heat medium 15*b*, and the second refrigerant flow switching device 18*b* constitute another one of the refrigerant passages constituting the refrigerant circuit A). In addition, heat medium passages of the heat exchangers related to heat medium 15, the pumps 21, the first heat medium flow switching devices 22, the heat medium flow control devices 25, the use side heat exchangers 26, and the second heat medium flow switching devices 23 are connected by the pipes 5, thus forming the heat medium circuits B. In other words, a plurality of use side heat exchangers 26 is connected in parallel to each of the heat exchangers related to heat medium 15, thus providing a plurality of heat medium circuits B.

Accordingly, in the air-conditioning apparatus 100, the outdoor unit 1 and the heat medium relay unit 3 are connected through the heat exchangers related to heat medium 15*a* and the heat exchangers related to heat medium 15*b* arranged in the heat medium relay unit 3. The heat medium relay unit 3 and each indoor unit 2 are also connected through the heat exchangers related to heat medium 15*a* and the heat exchangers related to heat medium 15*b*. In other words, in the air-conditioning apparatus 100, the heat exchangers related to heat medium 15*a* and the heat exchangers related to heat medium 15*b* each exchange heat between the heat source side refrigerant circulating in the refrigerant circuit A and the heat medium circulating in the heat medium circuits B.

Figure 4:
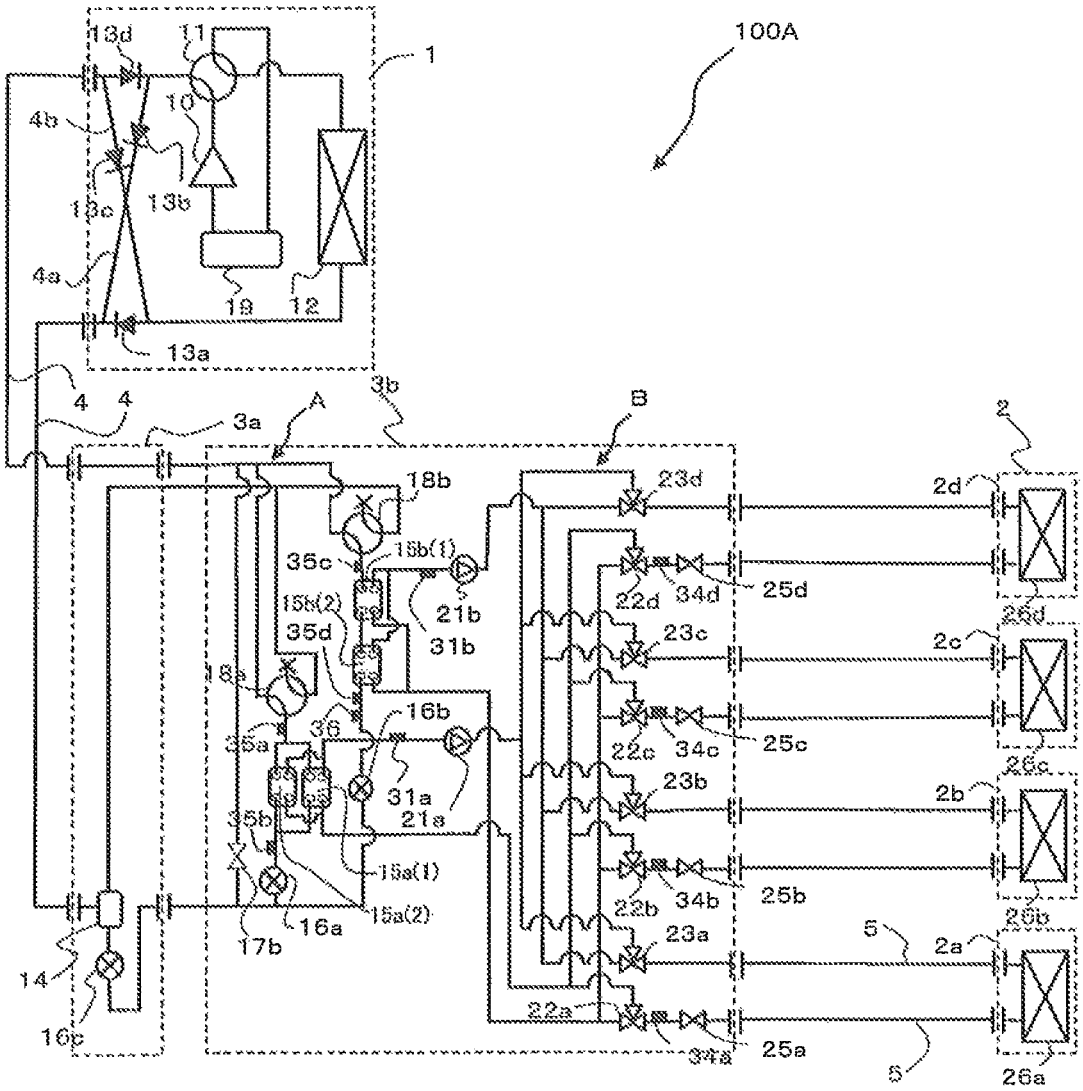
FIG. 4 is a schematic configuration diagram illustrating another exemplary circuit configuration of the air-conditioning apparatus according to Embodiment of the present invention.

FIG. 4 is a schematic configuration diagram illustrating another exemplary circuit configuration of the air-conditioning apparatus (hereinafter, referred to as an "air-conditioning apparatus 100A") according to Embodiment of the present invention. The circuit configuration of the air-conditioning apparatus 100A in the case where the heat medium relay unit 3 is separated into the main heat medium relay unit 3*a* and the sub heat medium relay unit 3*b* will be described with reference to FIG. 4. Referring to FIG. 4, the housing of the heat medium relay unit 3 is separated such that the heat medium relay unit 3 is composed of the main heat medium relay unit 3*a* and the sub heat medium relay unit 3*b*. This separation enables a plurality of sub heat medium relay units 3*b* to be connected to the single main heat medium relay unit 3*a* as illustrated in FIG. 2.

The main heat medium relay unit 3*a* includes a gas-liquid separator 14 and an expansion device 16*c*. The other components are arranged in the sub heat medium relay unit 3*b*. The gas-liquid separator 14 is connected to one refrigerant pipe 4 connected to the outdoor unit 1 and is connected to two refrigerant pipes 4 connected to the heat exchangers related to heat medium 15*a* and the heat exchangers related to heat medium 15*b* in the sub heat medium relay unit 3*b*, and is configured to separate the heat source side refrigerant supplied from the outdoor unit 1 into a vapor refrigerant and a liquid refrigerant. The expansion device 16*c*, disposed downstream in the flow direction of the liquid refrigerant flowing out of the gas-liquid separator 14, has functions of a reducing valve and an expansion valve and is configured to reduce the pressure of the heat source side refrigerant in order to expand it. During a cooling and heating mixed operation, the pressure of the refrigerant at an outlet of the expansion device 16*c* is controlled to a medium level. The expansion device 16*c* may include a component having a variably controllable opening degree, for example, an electronic expansion valve. This arrangement enables a plurality of sub heat medium relay units 3*b* to be connected to the main heat medium relay unit 3*a*.

The operation modes carried out by the air-conditioning apparatus 100 will be described. The air-conditioning apparatus 100 enables each indoor unit 2, on the basis of instructions from the indoor unit 2, to perform a cooling operation or heating operation. Specifically, the air-conditioning apparatus 100 enables all of the indoor units 2 to perform the same operation and also enables the indoor units 2 to perform different operations. Note that since the same applies to operation modes carried out by the air-conditioning apparatus 100A, description of the operation modes carried out by the air-conditioning apparatus 100A is omitted. In the following description, the air-conditioning apparatus 100 includes the air-conditioning apparatus 100A.

The operation modes carried out by the air-conditioning apparatus 100 include the cooling only operation mode in which all of the operating indoor units 2 perform the cooling operation, the heating only operation mode in which all of the operating indoor units 2 perform the heating operation, the cooling main operation mode of the cooling and heating mixed operation mode in which a cooling load is larger than a heating load, and the heating main operation mode of the cooling and heating mixed operation mode in which a heating load is larger than a cooling load. The operation modes will be described below with respect to the flow of the heat source side refrigerant and that of the heat medium.

[Cooling Only Operation Mode]

Figure 5:
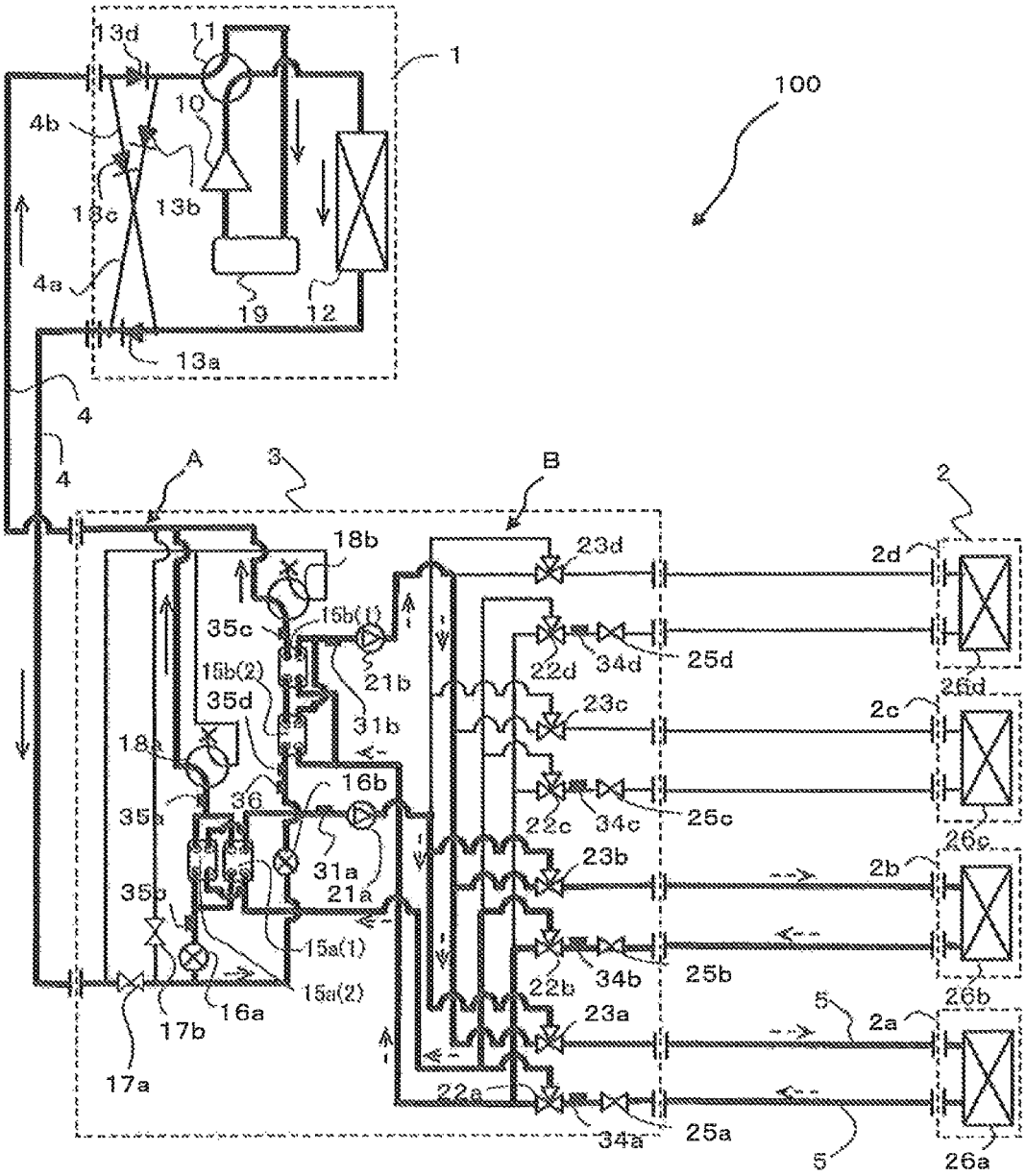
FIG. 5 is a refrigerant circuit diagram illustrating flows of refrigerants in a cooling only operation mode of the air-conditioning apparatus according to Embodiment of the present invention.

FIG. 5 is a refrigerant circuit diagram illustrating the flows of refrigerants in the cooling only operation mode of the air-conditioning apparatus 100. The cooling only operation mode will be described with respect to a case where a cooling load is generated only in the use side heat exchanger 26*a* and the use side heat exchanger 26*b* in FIG. 5. In FIG. 5, pipes indicated by thick lines correspond to pipes through which the refrigerants (the heat source side refrigerant and the heat medium) flow. Furthermore, in FIG. 5, solid-line arrows indicate a flow direction of the heat source side refrigerant and broken-line arrows indicate a flow direction of the heat medium.

In the cooling only operation mode illustrated in FIG. 5, in the outdoor unit 1, the first refrigerant flow switching device 11 is allowed to perform switching such that the heat source side refrigerant discharged from the compressor 10 flows into the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are totally closed such that the heat medium circulates between the heat exchangers related to heat medium 15*a* and the use side heat exchangers 26*a* and 26*b* and also circulates between the heat exchangers related to heat medium 15*b* and the use side heat exchangers 26*a* and 26*b*.

First, the flow of the heat source side refrigerant in the refrigerant circuit A will be described.

A low-temperature, low-pressure refrigerant is compressed by the compressor 10 and is discharged as a high-temperature, high-pressure gas refrigerant therefrom. The high-temperature, high-pressure gas refrigerant discharged from the compressor 10 flows through the first refrigerant flow switching device 11 into the heat source side heat exchanger 12. Then, the refrigerant is condensed and liquefied while transferring heat to outdoor air in the heat source side heat exchanger 12, such that it turns into a high-pressure liquid refrigerant. The high-pressure liquid refrigerant flowing out of the heat source side heat exchanger 12 passes through the check valve 13*a*, flows out of the outdoor unit 1, passes through the refrigerant pipe 4, and flows into the heat medium relay unit 3. The high-pressure liquid refrigerant, which has flowed into the heat medium relay unit 3, passes through the opening and closing device 17*a* and is then divided into flows to the expansion device 16*a* and the expansion device 16*b*, in each of which the refrigerant is expanded into a low-temperature, low-pressure two-phase refrigerant.

These flows of two-phase refrigerant enter the heat exchangers related to heat medium 15*a* and the heat exchangers related to heat medium 15*b*, functioning as evaporators, in each of which the refrigerant removes heat from the heat medium circulating in the heat medium circuits B to cool the heat medium, and thus turns into a low-temperature, low-pressure gas refrigerant. As described above, the heat exchanger related to heat medium 15*a*(1) and the heat exchanger related to heat medium 15*a*(2) are connected in parallel relative to the flow of the heat source side refrigerant, and the heat exchanger related to heat medium 15*b*(1) and the heat exchanger related to heat medium 15*b*(2) are connected in series relative to the flow of the heat source side refrigerant.

In the cooling only operation mode, the low-temperature, low-pressure heat source side refrigerant flows through each heat exchanger related to heat medium. A low-pressure refrigerant has low density. Accordingly, if the refrigerant passage of each heat exchanger related to heat medium has a small area, pressure loss of the refrigerant becomes high, thus leading to a reduction in the performance of the refrigeration cycle. Parallel connection of the heat exchanger related to heat medium 15*a*(1) and the heat exchanger related to heat medium 15*a*(2) allows the passages to have an adequate area. A reduction in the performance caused by pressure loss is, therefore, not so large.

The gas refrigerant, which has flowed from the heat exchanger related to heat medium 15*a*(1), the heat exchanger related to heat medium 15*a*(2), the heat exchanger related to heat medium 15*b*(1), and the heat exchanger related to heat medium 15*b*(2), flows out of the heat medium relay unit 3 after passing through the second refrigerant flow switching device 18*a* and the second refrigerant flow switching device 18*b*, passes through the refrigerant pipe 4, and again flows into the outdoor unit 1. The refrigerant, which has flowed into the outdoor unit 1, passes through the check valve 13*d*, the first refrigerant flow switching device 11, and the accumulator 19, and is then again suctioned into the compressor 10.

At this time, the opening degree of the expansion device 16*a* is controlled such that superheat (the degree of superheat) is constant, the superheat being obtained as the difference between the temperature detected by the third temperature sensor 35*a* and that detected by the third temperature sensor 35*b*. Similarly, the opening degree of the expansion device 16*b* is controlled such that superheat is constant, the superheat being obtained as the difference between the temperature detected by the third temperature sensor 35*c* and that detected by the third temperature sensor 35*d*. The opening and closing device 17*a* is opened and the opening and closing device 17*b* is closed.

Next, the flow of the heat medium in the heat medium circuits B will be described.

In the cooling only operation mode, all of the heat exchangers related to heat medium 15*a* and the heat exchangers related to heat medium 15*b* transfer cooling energy of the heat source side refrigerant to the heat medium and the pump 21*a* and the pump 21*b* allow the cooled heat medium to flow through the pipes 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*. The heat medium removes heat from the indoor air through each of the use side heat exchanger 26*a* and the use side heat exchanger 26*b*, thus cooling the indoor space 7.

Then, the heat medium flows out of each of the use side heat exchanger 26*a* and the use side heat exchanger 26*b* and flows into the corresponding one of the heat medium flow control device 25*a* and the heat medium flow control device 25*b*. At this time, each of the heat medium flow control device 25*a* and the heat medium flow control device 25*b* controls a flow rate of the heat medium as necessary to cover an air conditioning load required in the indoor space, such that the controlled flow rate of the heat medium flows into the corresponding one of the use side heat exchanger 26*a* and the use side heat exchanger 26*b*. The heat medium, which has flowed out of the heat medium flow control device 25*a* and the heat medium flow control device 25*b*, passes through the first heat medium flow switching device 22*a* and the first heat medium flow switching device 22*b*, flows into the heat exchangers related to heat medium 15*a* and the heat exchangers related to heat medium 15*b*, and is then again suctioned into the pump 21*a* and the pump 21*b*.

Note that in the pipe 5 in each use side heat exchanger 26, the heat medium flows in a direction in which it flows from the second heat medium flow switching device 23 through the heat medium flow control device 25 to the first heat medium flow switching device 22. Furthermore, the difference between the temperature detected by the first temperature sensor 31*a* or that detected by the first temperature sensor 31*b* and the temperature detected by the second temperature sensor 34 is controlled such that the difference is held at a target value, so that the air conditioning load required in the indoor space 7 can be covered. As regards the temperature on the outlet side of the heat exchangers related to heat medium 15, either the temperature detected by the first temperature sensor 31*a* or that detected by the first temperature sensor 31*b* may be used. Alternatively, the mean temperature of them may be used. At this time, the opening degree of each of the first heat medium flow switching devices 22 and the second heat medium flow switching devices 23 is controlled such that passages from and to all of the heat exchangers related to heat medium 15*a* and the heat exchangers related to heat medium 15*b* are established and a flow rate appropriate to the amount of heat exchanged flows through each device.

Upon carrying out the cooling only operation mode, since it is unnecessary to supply the heat medium to each use side heat exchanger 26 having no thermal load (including thermo-off state), the passage is closed by the corresponding heat medium flow control device 25 such that the heat medium does not flow into the use side heat exchanger 26. In FIG. 5, the heat medium flows into the use side heat exchanger 26*a* and the use side heat exchanger 26*b* because these use side heat exchangers each have a thermal load. The use side heat exchanger 26*c* and the use side heat exchanger 26*d* have no thermal load and the corresponding heat medium flow control devices 25*c* and 25*d* are totally closed. When a thermal load is generated in the use side heat exchanger 26*c* or the use side heat exchanger 26*d*, the heat medium flow control device 25*c* or the heat medium flow control device 25*d* may be opened such that the heat medium is circulated.

[Heating Only Operation Mode]

Figure 6:
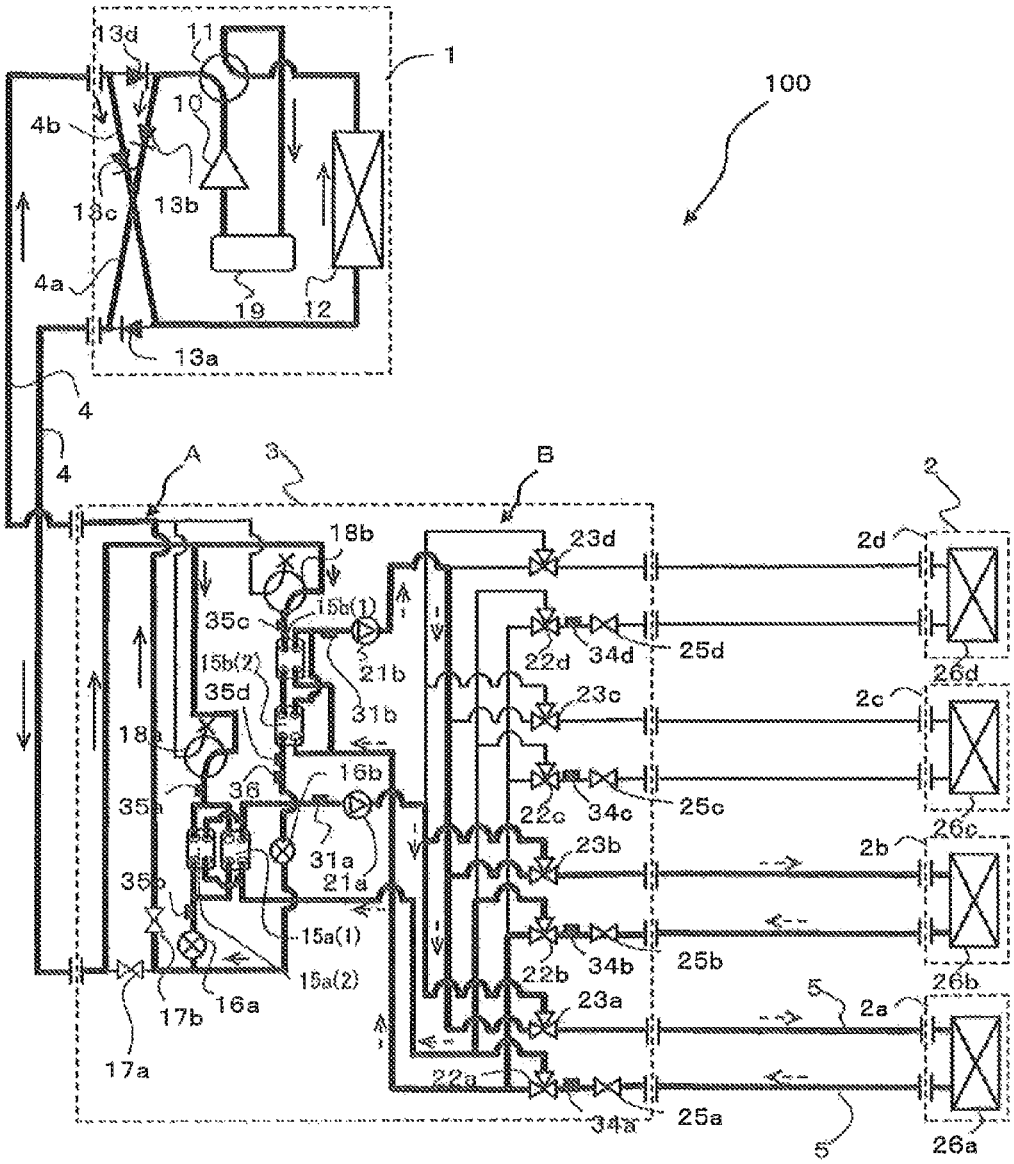
FIG. 6 is a refrigerant circuit diagram illustrating the flows of the refrigerants in a heating only operation mode of the air-conditioning apparatus according to Embodiment of the present invention.

FIG. 6 is a refrigerant circuit diagram illustrating the flows of the refrigerants in the heating only operation mode of the air-conditioning apparatus 100. The heating only operation mode will be described with respect to a case where a heating load is generated only in the use side heat exchanger 26*a* and the use side heat exchanger 26*b* in FIG. 6. In FIG. 6, pipes indicated by thick lines correspond to pipes through which the refrigerants (the heat source side refrigerant and the heat medium) flow. Furthermore, in FIG. 6, solid-line arrows indicate a flow direction of the heat source side refrigerant and broken-line arrows indicate a flow direction of the heat medium.

In the heating only operation mode illustrated in FIG. 6, in the outdoor unit 1, the first refrigerant flow switching device 11 is allowed to perform switching such that the heat source side refrigerant discharged from the compressor 10 flows into the heat medium relay unit 3 without passing through the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are totally closed such that the heat medium circulates between the heat exchangers related to heat medium 15*a* and the use side heat exchangers 26*a* and 26*b* and also circulates between the heat exchangers related to heat medium 15*b* and the use side heat exchangers 26*a* and 26*b*.

First, the flow of the heat source side refrigerant in the refrigerant circuit A will be described.

A low-temperature, low-pressure refrigerant is compressed by the compressor 10 and is discharged as a high-temperature, high-pressure gas refrigerant therefrom. The high-temperature, high-pressure gas refrigerant discharged from the compressor 10 passes through the first refrigerant flow switching device 11, flows through the first connecting pipe 4*a*, passes through the check valve 13*b*, and flows out of the outdoor unit 1. The high-temperature, high-pressure gas refrigerant, which has flowed out of the outdoor unit 1, passes through the refrigerant pipe 4 and flows into the heat medium relay unit 3. The high-temperature, high-pressure gas refrigerant, which has flowed into the heat medium relay unit 3, is divided into flows such that the flows pass through the second refrigerant flow switching device 18*a* and the second refrigerant flow switching device 18*b* and then enter the heat exchangers related to heat medium 15*a* and the heat exchangers related to heat medium 15*b*.

The high-temperature, high-pressure gas refrigerant, which has flowed into the heat exchangers related to heat medium 15*a* and the heat exchangers related to heat medium 15*b*, is condensed and liquefied while transferring heat to the heat medium circulating in the heat medium circuits B, such that it turns into a high-pressure liquid refrigerant. As described above, the heat exchanger related to heat medium 15*a*(1) and the heat exchanger related to heat medium 15*a*(2) are connected in parallel relative to the flow of the heat source side refrigerant, and the heat exchanger related to heat medium 15*b*(1) and the heat exchanger related to heat medium 15*b*(2) are connected in series relative to the flow of the heat source side refrigerant.

In the heating only operation mode, the high-temperature, high-pressure heat source side refrigerant flows through each heat exchanger related to heat medium. Since the high-pressure refrigerant has high density, pressure loss of the heat source side refrigerant in the heat exchanger related to heat medium is not so large. On the other hand, the heat exchanger related to heat medium 15*b*(1) and the heat exchanger related to heat medium 15*b*(2) are connected in series. Accordingly, the flow velocity of the heat source side refrigerant in these heat exchangers related to heat medium is increased to enhance the heat transfer coefficient of the heat source side refrigerant, so that the heat exchange efficiency between the heat source side refrigerant and the heat medium is improved. Thus, the efficiency of the entire refrigeration cycle is improved.

The liquid refrigerant flowing from the heat exchanger related to heat medium 15*a*(1) and the heat exchanger related to heat medium 15*a*(2) and that flowing from the heat exchanger related to heat medium 15*b*(1) and the heat exchanger related to heat medium 15*b*(2) are expanded into a low-temperature, low-pressure two-phase refrigerant by the expansion device 16*a* and the expansion device 16*b*, respectively. This two-phase refrigerant passes through the opening and closing device 17*b*, flows out of the heat medium relay unit 3, passes through the refrigerant pipe 4, and again flows into the outdoor unit 1. The refrigerant, which has flowed into the outdoor unit 1, flows through the second connecting pipe 4*b*, passes through the check valve 13*c*, and flows into the heat source side heat exchanger 12, functioning as an evaporator.

The heat source side refrigerant, which has flowed into the heat source side heat exchanger 12, removes heat from the outdoor air in the heat source side heat exchanger 12, such that it turns into a low-temperature, low-pressure gas refrigerant. The low-temperature, low-pressure gas refrigerant, which has flowed out of the heat source side heat exchanger 12, passes through the first refrigerant flow switching device 11 and the accumulator 19 and is again suctioned into the compressor 10.

At this time, the opening degree of the expansion device 16*a* is controlled such that subcooling (the degree of subcooling) is constant, the subcooling being obtained as the difference between the saturation temperature converted from the pressure detected by the pressure sensor 36 and the temperature detected by the third temperature sensor 35*b*. Similarly, the opening degree of the expansion device 16*b* is controlled such that subcooling is constant, the subcooling being obtained as the difference between the saturation temperature converted from the pressure detected by the pressure sensor 36 and the temperature detected by the third temperature sensor 35*d*. The opening and closing device 17*a* is closed and the opening and closing device 17*b* is opened. Note that in the case where the temperature at the middle position of each heat exchanger related to heat medium 15 can be measured, the temperature at the middle position may be used instead of the pressure detected by the pressure sensor 36. Thus, such a system can be established inexpensively.

Next, the flow of the heat medium in the heat medium circuits B will be described.

In the heating only operation mode, both of the heat exchangers related to heat medium 15*a* and the heat exchangers related to heat medium 15*b* transfer heating energy of the heat source side refrigerant to the heat medium and the pump 21*a* and the pump 21*b* allow the heated heat medium to flow through the pipes 5. The heat medium, which has flowed out of each of the pump 21*a* and the pump 21*b* while being pressurized, flows through the second heat medium flow switching device 23*a* and the second heat medium flow switching device 23*b* into the use side heat exchanger 26*a* and the use side heat exchanger 26*b*. The heat medium transfers heat to the indoor air through each of the use side heat exchanger 26*a* and the use side heat exchanger 26*b*, thus heating the indoor space 7.

Then, the heat medium flows out of each of the use side heat exchanger 26*a* and the use side heat exchanger 26*b* and flows into the corresponding one of the heat medium flow control device 25*a* and the heat medium flow control device 25*b*. At this time, each of the heat medium flow control device 25*a* and the heat medium flow control device 25*b* controls a flow rate of the heat medium as necessary to cover an air conditioning load required in the indoor space, such that the controlled flow rate of the heat medium flows into the corresponding one of the use side heat exchanger 26*a* and the use side heat exchanger 26*b*. The heat medium, which has flowed out of the heat medium flow control device 25*a* and the heat medium flow control device 25*b*, passes through the first heat medium flow switching device 22*a* and the first heat medium flow switching device 22*b*, flows into the heat exchangers related to heat medium 15*a* and the heat exchangers related to heat medium 15*b*, and is then again suctioned into the pump 21*a* and the pump 21*b*.

Note that in the pipe 5 in each use side heat exchanger 26, the heat medium flows in the direction in which it flows from the second heat medium flow switching device 23 through the heat medium flow control device 25 to the first heat medium flow switching device 22. Furthermore, the difference between the temperature detected by the first temperature sensor 31*a* or that detected by the first temperature sensor 31*b* and the temperature detected by the second temperature sensor 34 is controlled such that the difference is held at a target value, so that the air conditioning load required in the indoor space 7 can be covered. As regards the temperature on the outlet side of the heat exchangers related to heat medium 15, either the temperature detected by the first temperature sensor 31*a* or that detected by the first temperature sensor 31*b* may be used. Alternatively, the mean temperature of them may be used.

At this time, the opening degree of each of the first heat medium flow switching devices 22 and the second heat medium flow switching devices 23 is controlled such that the passages from and to all of the heat exchangers related to heat medium 15*a* and the heat exchangers related to heat medium 15*b* are established and the flow rate appropriate to the amount of heat exchanged flows through each device. Although the use side heat exchanger 26*a* should essentially be controlled on the basis of the difference between the temperature at the inlet and that at the outlet, since the temperature of the heat medium on the inlet side of the use side heat exchanger 26 is substantially the same as the temperature detected by the first temperature sensor 31*b*, the use of the first temperature sensor 31*b* can reduce the number of temperature sensors, so that the system can be established inexpensively.

Upon carrying out the heating only operation mode, since it is unnecessary to supply the heat medium to each use side heat exchanger 26 having no thermal load (including thermo-off state), the passage is closed by the corresponding heat medium flow control device 25 such that the heat medium does not flow into the use side heat exchanger 26. In FIG. 6, the heat medium flows into the use side heat exchanger 26*a* and the use side heat exchanger 26*b* because these use side heat exchangers each have a thermal load. The use side heat exchanger 26*c* and the use side heat exchanger 26*d* have no thermal load and the corresponding heat medium flow control devices 25*c* and 25*d* are totally closed. When a thermal load is generated in the use side heat exchanger 26*c* or the use side heat exchanger 26*d*, the heat medium flow control device 25*c* or the heat medium flow control device 25*d* may be opened such that the heat medium is circulated.

[Cooling Main Operation Mode]

Figure 7:
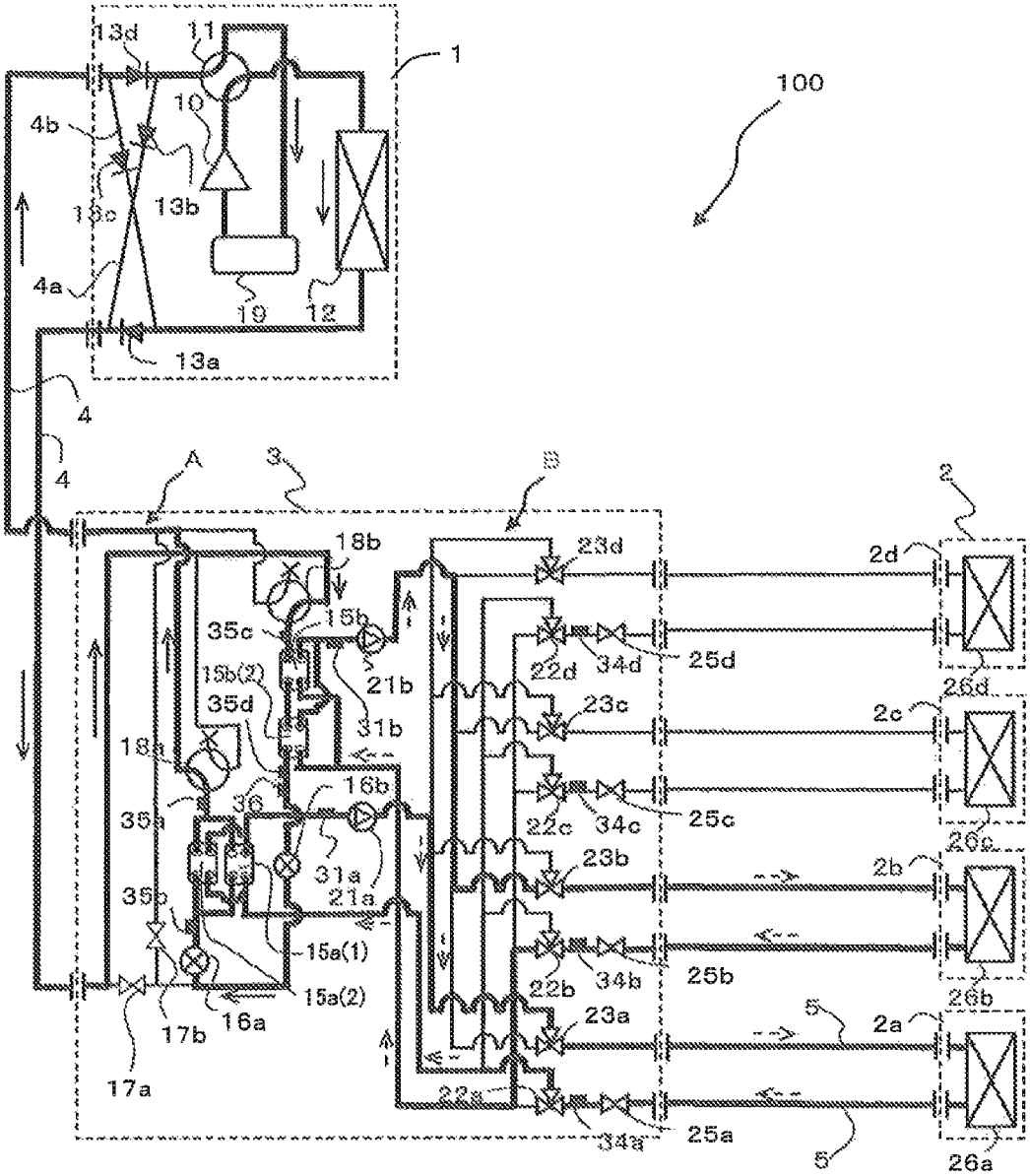
FIG. 7 is a refrigerant circuit diagram illustrating the flows of the refrigerants in a cooling main operation mode of the air-conditioning apparatus according to Embodiment of the present invention.

FIG. 7 is a refrigerant circuit diagram illustrating the flows of refrigerants in the cooling main operation mode of the air-conditioning apparatus 100. The cooling main operation mode will be described with respect to a case where a cooling load is generated in the use side heat exchanger 26*a* and a heating load is generated in the use side heat exchanger 26*b* in FIG. 7. In FIG. 7, pipes indicated by thick lines correspond to the pipes through which the refrigerants (the heat source side refrigerant and the heat medium) circulate. Furthermore, in FIG. 7, solid-line arrows indicate the flow direction of the heat source side refrigerant and broken-line arrows indicate the flow direction of the heat medium.

In the cooling main operation mode illustrated in FIG. 7, in the outdoor unit 1, the first refrigerant flow switching device 11 is allowed to perform switching such that the heat source side refrigerant discharged from the compressor 10 flows into the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are totally closed such that the heat medium circulates between the heat exchangers related to heat medium 15*a* and the use side heat exchanger 26*a* and also circulates between the heat exchangers related to heat medium 15*b* and the use side heat exchanger 26*b*.

First, the flow of the heat source side refrigerant in the refrigerant circuit A will be described.

A low-temperature, low-pressure refrigerant is compressed by the compressor 10 and is discharged as a high-temperature, high-pressure gas refrigerant therefrom. The high-temperature, high-pressure gas refrigerant discharged from the compressor 10 flows through the first refrigerant flow switching device 11 into the heat source side heat exchanger 12. The refrigerant condenses into a two-phase refrigerant in the heat source side heat exchanger 12 while transferring heat to the outside air. The two-phase refrigerant, which has flowed out of the heat source side heat exchanger 12, passes through the check valve 13*a*, flows out of the outdoor unit 1, passes through the refrigerant pipe 4, and flows into the heat medium relay unit 3. The two-phase refrigerant, which has flowed into the heat medium relay unit 3, passes through the second refrigerant flow switching device 18*b* and flows into the heat exchangers related to heat medium 15*b*, functioning as condensers.

The two-phase refrigerant, which has flowed into the heat exchangers related to heat medium 15*b* is condensed and liquefied while transferring heat to the heat medium circulating in the heat medium circuits B, such that it turns into a liquid refrigerant. In this case, since the heat exchanger related to heat medium 15*b*(1) and the heat exchanger related to heat medium 15*b*(2) are connected in series relative to the flow of the heat source side refrigerant, the flow velocity of the heat source side refrigerant in these heat exchangers related to heat medium is increased, to enhance the heat transfer coefficient thereof. Thus, the heat exchange efficiency between the heat source side refrigerant and the heat medium is improved. Since the high-temperature, high-pressure refrigerant having high refrigerant density flows therethrough, however, pressure loss of the heat source side refrigerant is not so large.

The liquid refrigerant, which has flowed from the heat exchangers related to heat medium 15*b*, is expanded into a low-pressure, two-phase refrigerant by the expansion device 16*b*. This low-pressure, two-phase refrigerant flows through the expansion device 16*a* into the heat exchangers related to heat medium 15*a*, functioning as evaporators. The low pressure, two-phase refrigerant, which has flowed into the heat exchangers related to heat medium 15*a*, removes heat from the heat medium circulating in the heat medium circuits B to cool the heat medium, and thus turns into a low-pressure gas refrigerant. In this case, since the heat exchanger related to heat medium 15*a*(1) and the heat exchanger related to heat medium 15*a*(2) are connected in parallel relative to the flow of the heat source side refrigerant, the area of passages for the heat source side refrigerant in these heat exchangers related to heat medium can be adequately provided. If a low-pressure refrigerant having low density flows therethrough, pressure loss of the heat source side refrigerant is not so large. The performance of the refrigeration cycle can therefore be prevented from being reduced.

The gas refrigerant, which has flowed from the heat exchangers related to heat medium 15*a*, flows through the second refrigerant flow switching device 18*a* out of the heat medium relay unit 3, passes through the refrigerant pipe 4, and again flows into the outdoor unit 1. The heat source side refrigerant, which has flowed into the outdoor unit 1, passes through the check valve 13*d*, the first refrigerant flow switching device 11, and the accumulator 19, and is then again suctioned into the compressor 10.

At this time, the opening degree of the expansion device 16*b* is controlled such that superheat is constant, the superheat being obtained as the difference between the temperature detected by the third temperature sensor 35*a* and that detected by the third temperature sensor 35*b*. The expansion device 16*a* is fully opened, the opening and closing device 17*a* is closed, and the opening and closing device 17*b* is closed. Note that the opening degree of the expansion device 16*b* may be controlled such that subcooling is constant, the subcooling being obtained as the difference between the saturation temperature converted from the pressure detected by the pressure sensor 36 and the temperature detected by the third temperature sensor 35*d*. Alternatively, the expansion device 16*b* may be fully opened and the expansion device 16*a* may control the superheat or the subcooling.

Next, the flow of the heat medium in the heat medium circuits B will be described.

In the cooling main operation mode, the heat exchangers related to heat medium 15*b* transfer heating energy of the heat source side refrigerant to the heat medium and the pump 21*b* allows the heated heat medium to flow through the pipes 5. Furthermore, in the cooling main operation mode, the heat exchangers related to heat medium 15*a* transfer cooling energy of the heat source side refrigerant to the heat medium and the pump 21*a* allows the cooled heat medium to flow through the pipes 5. The heat medium, which has flowed out of each of the pump 21*a* and the pump 21*b* while being pressurized, flows through the corresponding one of the second heat medium flow switching device 23*a* and the second heat medium flow switching device 23*b* into the corresponding one of the use side heat exchanger 26*a* and the use side heat exchanger 26*b*.

In the use side heat exchanger 26*b*, the heat medium transfers heat to the indoor air, thus heating the indoor space 7. In addition, in the use side heat exchanger 26*a*, the heat medium removes heat from the indoor air, thus cooling the indoor space 7. At this time, each of the heat medium flow control device 25*a* and the heat medium flow control device 25*b* controls a flow rate of the heat medium as necessary to cover an air conditioning load required in the indoor space, such that the controlled flow rate of the heat medium flows into the corresponding one of the use side heat exchanger 26*a* and the use side heat exchanger 26*b*. The heat medium, which has passed through the use side heat exchanger 26*b* with a slight decrease of temperature, passes through the heat medium flow control device 25*b* and the first heat medium flow switching device 22*b*, flows into the heat exchangers related to heat medium 15*b*, and is then again suctioned into the pump 21*b*. The heat medium, which has passed through the use side heat exchanger 26*a* with a slight increase of temperature, passes through the heat medium flow control device 25*a* and the first heat medium flow switching device 22*a*, flows into the heat exchangers related to heat medium 15*a*, and is then again suctioned into the pump 21*a*.

During this time, the first heat medium flow switching devices 22 and the second heat medium flow switching devices 23 allow the warm heat medium and the cold heat medium to be introduced into the use side heat exchanger 26 having a heating load and the use side heat exchanger 26 having a cooling load, respectively, without mixing with each other. Note that in the pipe 5 in each use side heat exchanger 26 for heating and that for cooling, the heat medium flows in the direction in which it flows from the second heat medium flow switching device 23 through the heat medium flow control device 25 to the first heat medium flow switching device 22. Furthermore, the difference between the temperature detected by the first temperature sensor 31*b* and that detected by each of the second temperature sensors 34 is controlled such that the difference is held at a target value, so that the air conditioning load required in the indoor space 7 to be heated can be covered. The difference between the temperature detected by each of the second temperature sensors 34 and that detected by the first temperature sensor 31*a* is controlled such that the difference is held at a target value, so that the air conditioning load required in the indoor space 7 to be cooled can be covered.

Upon carrying out the cooling main operation mode, since it is unnecessary to supply the heat medium to each use side heat exchanger 26 having no thermal load (including thermo-off state), the passage is closed by the corresponding heat medium flow control device 25 such that the heat medium does not flow into the use side heat exchanger 26. In FIG. 7, the heat medium flows into the use side heat exchanger 26*a* and the use side heat exchanger 26*b* because these use side heat exchangers each have a thermal load. The use side heat exchanger 26*c* and the use side heat exchanger 26*d* have no thermal load and the corresponding heat medium flow control devices 25*c* and 25*d* are totally closed. When a thermal load is generated in the use side heat exchanger 26*c* or the use side heat exchanger 26*d*, the heat medium flow control device 25*c* or the heat medium flow control device 25*d* may be opened such that the heat medium is circulated.

[Heating Main Operation Mode]

Figure 8:
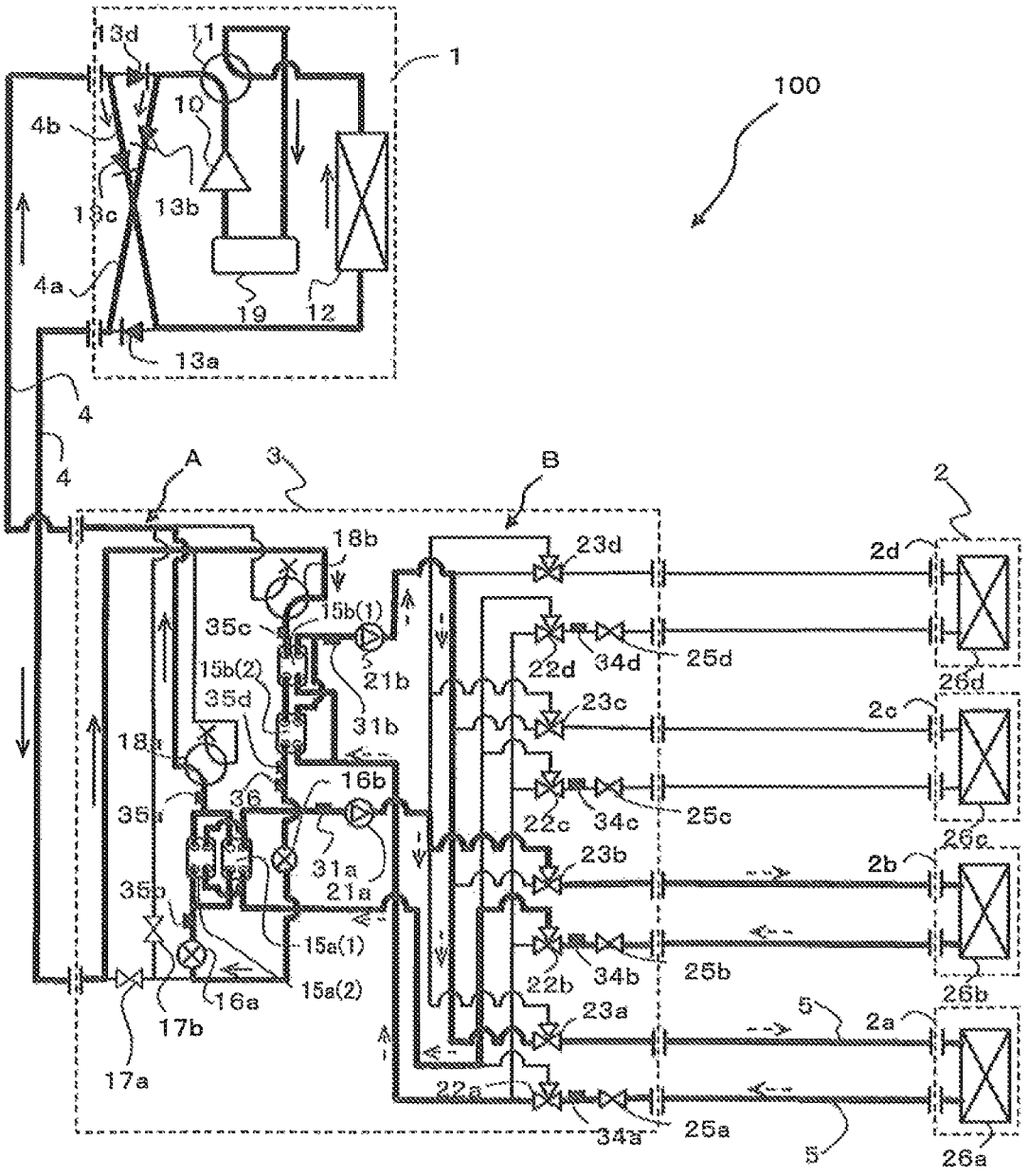
FIG. 8 is a refrigerant circuit diagram illustrating the flows of the refrigerants in a heating main operation mode of the air-conditioning apparatus according to Embodiment of the present invention.

FIG. 8 is a refrigerant circuit diagram illustrating the flows of refrigerants in the heating main operation mode of the air-conditioning apparatus 100. The heating main operation mode will be described with respect to a case where a heating load is generated in the use side heat exchanger 26*a* and a cooling load is generated in the use side heat exchanger 26*b* in FIG. 8. In FIG. 8, pipes indicated by thick lines correspond to the pipes through which the refrigerants (the heat source side refrigerant and the heat medium) circulate. Furthermore, in FIG. 8, solid-line arrows indicate the flow direction of the heat source side refrigerant and broken-line arrows indicate the flow direction of the heat medium.

In the heating main operation mode illustrated in FIG. 8, in the outdoor unit 1, the first refrigerant flow switching device 11 is allowed to perform switching such that the heat source side refrigerant discharged from the compressor 10 flows into the heat medium relay unit 3 without passing through the heat source side heat exchanger 12. In the heat medium relay unit 3, the pump 21*a* and the pump 21*b* are driven, the heat medium flow control device 25*a* and the heat medium flow control device 25*b* are opened, and the heat medium flow control device 25*c* and the heat medium flow control device 25*d* are totally closed such that the heat medium circulates between the heat exchangers related to heat medium 15*a* and the use side heat exchanger 26*b* and also circulates between the heat exchangers related to heat medium 15*b* and the use side heat exchanger 26*a*.

First, the flow of the heat source side refrigerant in the refrigerant circuit A will be described.

A low-temperature, low-pressure refrigerant is compressed by the compressor 10 and is discharged as a high-temperature, high-pressure gas refrigerant therefrom. The high-temperature, high-pressure gas refrigerant discharged from the compressor 10 passes through the first refrigerant flow switching device 11, flows through the first connecting pipe 4*a*, passes through the check valve 13*b*, and flows out of the outdoor unit 1. The high-temperature, high-pressure gas refrigerant, which has flowed out of the outdoor unit 1, passes through the refrigerant pipe 4 and flows into the heat medium relay unit 3. The high-temperature, high-pressure gas refrigerant, which has flowed into the heat medium relay unit 3, passes through the second refrigerant flow switching device 18*b* and flows into the heat exchangers related to heat medium 15*b*, functioning as condensers.

The gas refrigerant, which has flowed into the heat exchangers related to heat medium 15*b* is condensed and liquefied while transferring heat to the heat medium circulating in the heat medium circuits B, such that it turns into a liquid refrigerant. In this case, since the heat exchanger related to heat medium 15*b*(1) and the heat exchanger related to heat medium 15*b*(2) are connected in series relative to the flow of the heat source side refrigerant, the flow velocity of the heat source side refrigerant in these heat exchangers related to heat medium is increased, to enhance the heat transfer coefficient thereof. Thus, the heat exchange efficiency between the heat source side refrigerant and the heat medium is improved. Since the high-temperature, high-pressure refrigerant having high refrigerant density flows therethrough, however, pressure loss of the heat source side refrigerant is not so large.

The liquid refrigerant, which has flowed from the heat exchangers related to heat medium 15*b*, is expanded into a low-pressure, two-phase refrigerant by the expansion device 16*b*. This low-pressure, two-phase refrigerant flows through the expansion device 16*a* into the heat exchangers related to heat medium 15*a*, functioning as evaporators. The low pressure, two-phase refrigerant, which has flowed into the heat exchangers related to heat medium 15*a*, removes heat from the heat medium circulating in the heat medium circuits B such that the refrigerant is evaporated to cool the heat medium. In this case, since the heat exchanger related to heat medium 15*a*(1) and the heat exchanger related to heat medium 15*a*(2) are connected in parallel relative to the flow of the heat source side refrigerant, the area of passages for the heat source side refrigerant in these heat exchangers related to heat medium can be adequately provided. If a low-pressure refrigerant having low density flows therethrough, pressure loss of the heat source side refrigerant is not so large. The performance of the refrigeration cycle can therefore be prevented from being reduced.

The low-pressure, two-phase refrigerant, which has flowed from the heat exchangers related to heat medium 15*a*, flows through the second refrigerant flow switching device 18*a* out of the heat medium relay unit 3, passes through the refrigerant pipe 4, and again flows into the outdoor unit 1. The heat source side refrigerant, which has flowed into the outdoor unit 1, flows through the check valve 13*c* into the heat source side heat exchanger 12, functioning as an evaporator. The refrigerant, which has flowed into the heat source side heat exchanger 12, removes heat from the outdoor air in the heat source side heat exchanger 12, such that it turns into a low-temperature, low-pressure gas refrigerant. The low-temperature, low-pressure gas refrigerant, which has flowed out of the heat source side heat exchanger 12, passes through the first refrigerant flow switching device 11 and the accumulator 19 and is again suctioned into the compressor 10.

At this time, the opening degree of the expansion device 16*b* is controlled such that subcooling is constant, the subcooling being obtained as the difference between the saturation temperature converted from the pressure detected by the pressure sensor 36 and the temperature detected by the third temperature sensor 35*b*. The expansion device 16*a* is fully opened, the opening and closing device 17*a* is closed, and the opening and closing device 17*b* is closed. Note that the expansion device 16*b* may be fully opened and the expansion device 16*a* may control the subcooling.

Next, the flow of the heat medium in the heat medium circuits B will be described.

In the heating main operation mode, the heat exchangers related to heat medium 15*b* transfer heating energy of the heat source side refrigerant to the heat medium and the pump 21*b* allows the heated heat medium to flow through the pipes 5. Furthermore, in the heating main operation mode, the heat exchangers related to heat medium 15*a* transfer cooling energy of the heat source side refrigerant to the heat medium and the pump 21*a* allows the cooled heat medium to flow through the pipes 5. The heat medium, which has flowed out of each of the pump 21*a* and the pump 21*b* while being pressurized, flows through the corresponding one of the second heat medium flow switching device 23*a* and the second heat medium flow switching device 23*b* into the corresponding one of the use side heat exchanger 26*a* and the use side heat exchanger 26*b*.

In the use side heat exchanger 26*b*, the heat medium removes heat from the indoor air, thus cooling the indoor space 7. In addition, in the use side heat exchanger 26*a*, the heat medium transfers heat to the indoor air, thus heating the indoor space 7. At this time, each of the heat medium flow control device 25*a* and the heat medium flow control device 25*b* controls a flow rate of the heat medium as necessary to cover an air conditioning load required in the indoor space, such that the controlled flow rate of the heat medium flows into the corresponding one of the use side heat exchanger 26*a* and the use side heat exchanger 26*b*. The heat medium, which has passed through the use side heat exchanger 26*b* with a slight increase of temperature, passes through the heat medium flow control device 25*b* and the first heat medium flow switching device 22*b*, flows into the heat exchangers related to heat medium 15*a*, and is then again suctioned into the pump 21*a*. The heat medium, which has passed through the use side heat exchanger 26*a* with a slight decrease of temperature, passes through the heat medium flow control device 25*a* and the first heat medium flow switching device 22*a*, flows into the heat exchangers related to heat medium 15*b*, and is then again suctioned into the pump 21*b*.

During this time, the first heat medium flow switching devices 22 and the second heat medium flow switching devices 23 allow the warm heat medium and the cold heat medium to be introduced into the use side heat exchanger 26 having a heating load and the use side heat exchanger 26 having a cooling load, respectively, without mixing with each other. Note that in the pipe 5 in each use side heat exchanger 26 for heating and that for cooling, the heat medium flows in the direction in which it flows from the second heat medium flow switching device 23 through the heat medium flow control device 25 to the first heat medium flow switching device 22. Furthermore, the difference between the temperature detected by the first temperature sensor 31*b* and that detected by each of the second temperature sensors 34 is controlled such that the difference is held at a target value, so that the air conditioning load required in the indoor space 7 to be heated can be covered. The difference between the temperature detected by each of the second temperature sensors 34 and that detected by the first temperature sensor 31*a* is controlled such that the difference is held at a target value, so that the air conditioning load required in the indoor space 7 to be cooled can be covered.

Upon carrying out the heating main operation mode, since it is unnecessary to supply the heat medium to each use side heat exchanger 26 having no thermal load (including thermo-off state), the passage is closed by the corresponding heat medium flow control device 25 such that the heat medium does not flow into the use side heat exchanger 26. In FIG. 8, the heat medium flows into the use side heat exchanger 26*a* and the use side heat exchanger 26*b* because these use side heat exchangers each have a thermal load. The use side heat exchanger 26*c* and the use side heat exchanger 26*d* have no thermal load and the corresponding heat medium flow control devices 25*c* and 25*d* are totally closed. When a thermal load is generated in the use side heat exchanger 26*c* or the use side heat exchanger 26*d*, the heat medium flow control device 25*c* or the heat medium flow control device 25*d* may be opened such that the heat medium is circulated.

[Refrigerant Pipes 4]

As described above, the air-conditioning apparatus 100 according to Embodiment has the several operation modes. In these operation modes, the heat source side refrigerant flows through the refrigerant pipes 4 connecting the outdoor unit 1 and the heat medium relay unit 3.

[Pipes 5]

In the several operation modes carried out by the air-conditioning apparatus 100 according to Embodiment, the heat medium, such as water or antifreeze, flows through the pipes 5 connecting the heat medium relay unit 3 and the indoor units 2.

[Control of First Heat Medium Flow Switching Devices 22 and Second Heat Medium Flow Switching Devices 23]

As described above, in the cooling only operation mode and the heating only operation mode, the flow of the heat source side refrigerant is divided into two flows such that one flow enters the heat exchanger related to heat medium 15*a*(1) and the heat exchanger related to heat medium 15*a*(2) connected in parallel and the other flow enters the heat exchanger related to heat medium 15*b*(1) and the heat exchanger related to heat medium 15*b*(2) connected in series. In the refrigerant circuit A, the heat exchanging performance of the heat exchangers related to heat medium 15 and pressure loss vary depending on whether the heat exchangers related to heat medium 15 are connected in series or parallel.

Accordingly, the flow of the heat source side refrigerant is not equally divided into two flows, the one flow to the heat exchangers related to heat medium 15*a* and the other flow to the heat exchangers related to heat medium 15*b*. The flow of the heat source side refrigerant is divided in accordance with the heat exchanging performance and pressure loss. It is therefore necessary to control a flow rate of the heat medium flowing through each heat exchanger related to heat medium 15 in accordance with the amount of heat exchanged with the heat source side refrigerant. A method of controlling the first heat medium flow switching devices 22 (the first heat medium flow switching devices 22*a* to 22*d*) and the second heat medium flow switching devices 23 (the second heat medium flow switching devices 23*a* to 23*d*) to control the flow rate of the heat medium will be described below.

The temperature effectiveness of each heat exchanger related to heat medium 15 will now be described.

In the heat exchanger related to heat medium 15, the heat source side refrigerant exchanges heat with the heat medium. During heating, heating energy is transferred from the heat source side refrigerant to the heat medium. During cooling, cooling energy is transferred from the heat source side refrigerant to the heat medium. An index indicating the extent to which the temperature of the heat medium is close to that of the heat source side refrigerant at this time is the temperature effectiveness. Specifically, a state in which heat has been exchanged until the temperature of the heat medium at the outlet of the heat exchanger related to heat medium 15 is equal to the temperature of the heat source side refrigerant means the temperature effectiveness of 1. A state in which heat has been exchanged until the temperature of the heat medium at the outlet of the heat exchanger related to heat medium 15 reaches a middle temperature between the temperature of the heat medium at the inlet and the temperature of the heat source side refrigerant means the temperature effectiveness of 0.5.

As the flow velocity (flow rate) of the heat medium is lower, the temperature of the heat medium is closer to that of the heat source side refrigerant. Thus, the temperature effectiveness increases. Conversely, as the flow velocity (flow rate) of the heat medium is higher, the heat medium does not sufficiently exchange heat with the heat source side refrigerant. Thus, the temperature effectiveness decreases. Note that each of the first heat medium flow switching devices 22 and the second heat medium flow switching devices 23 is installed so as to have an orientation such that when the opening degree of the device is zero, the passage to or from the heat exchangers related to heat medium 15*a* is totally closed and the passage to or from the heat exchangers related to heat medium 15*b* is fully opened, and when the opening degree thereof is the maximum value, the passage to or from the heat exchangers related to heat medium 15*a* is fully opened and the passage to or from the heat exchangers related to heat medium 15*b* is totally closed.

The heating only operation mode in which each of the heat exchanger related to heat medium 15*a*(1), the heat exchanger related to heat medium 15*a*(2), the heat exchanger related to heat medium 15*b*(1), and the heat exchanger related to heat medium 15*b*(2) operates as a condenser for a refrigerant that undergoes a two-phase change or a gas cooler for a refrigerant, such as CO2, which undergoes a transition to a supercritical state will now be described.

In this case, as the opening degree of the first heat medium flow switching devices 22 and the second heat medium flow switching devices 23 are increased, the flow rate (flow velocity) of the heat medium flowing to the heat exchanger related to heat medium 15*a*(1) and the heat exchanger related to heat medium 15*a*(2) increases. Accordingly, the heat medium does not sufficiently exchange heat with the refrigerant in the heat exchanger related to heat medium 15*a*(1) and the heat exchanger related to heat medium 15*a*(2), so that the temperature effectiveness of the heat exchanger related to heat medium 15*a*(1) and the heat exchanger related to heat medium 15*a*(2) decreases. A change in temperature of the heat medium in the heat exchangers related to heat medium 15*a* also decreases, so that a heat medium outlet temperature (temperature detected by the first temperature sensor 31*a*) falls.

As regards the heat exchangers related to heat medium 15*b*, as the opening degree of the first heat medium flow switching devices 22 and the second heat medium flow switching devices 23 are increased, the flow rate (flow velocity) of the heat medium flowing to the heat exchanger related to heat medium 15*b*(1) and the heat exchanger related to heat medium 15*b*(2) decreases. Accordingly, the temperature effectiveness of the heat exchanger related to heat medium 15*b*(1) and the heat exchanger related to heat medium 15*b*(2) increases, so that the temperature of the heat medium on the outlet side is closer to the temperature of the refrigerant. Thus, a heat medium outlet temperature (temperature detected by the first temperature sensor 31*b*) rises.

On the other hand, as the opening degree of the first heat medium flow switching device 22 and the second heat medium flow switching devices 23 are reduced, the opposite of the above occurs, namely, the heat medium outlet temperature (temperature detected by the first temperature sensor 31*a*) rises and the heat medium outlet temperature (temperature detected by the first temperature sensor 31*b*) falls. In other words, it will be understood that controlling the opening degrees of the first heat medium flow switching devices 22 and the second heat medium flow switching devices 23 can control the temperature of the heat medium on the outlet sides of the heat exchangers related to heat medium 15.

Note that it is preferable to control the heat medium flow switching devices corresponding to each other, such as the first heat medium flow switching device 22 and the second heat medium flow switching device 23, such that the devices inevitably have the same opening degree in the same direction, because these heat medium flow switching devices are arranged on the inlet side and the outlet side of each use side heat exchanger 26.

Figure 9:
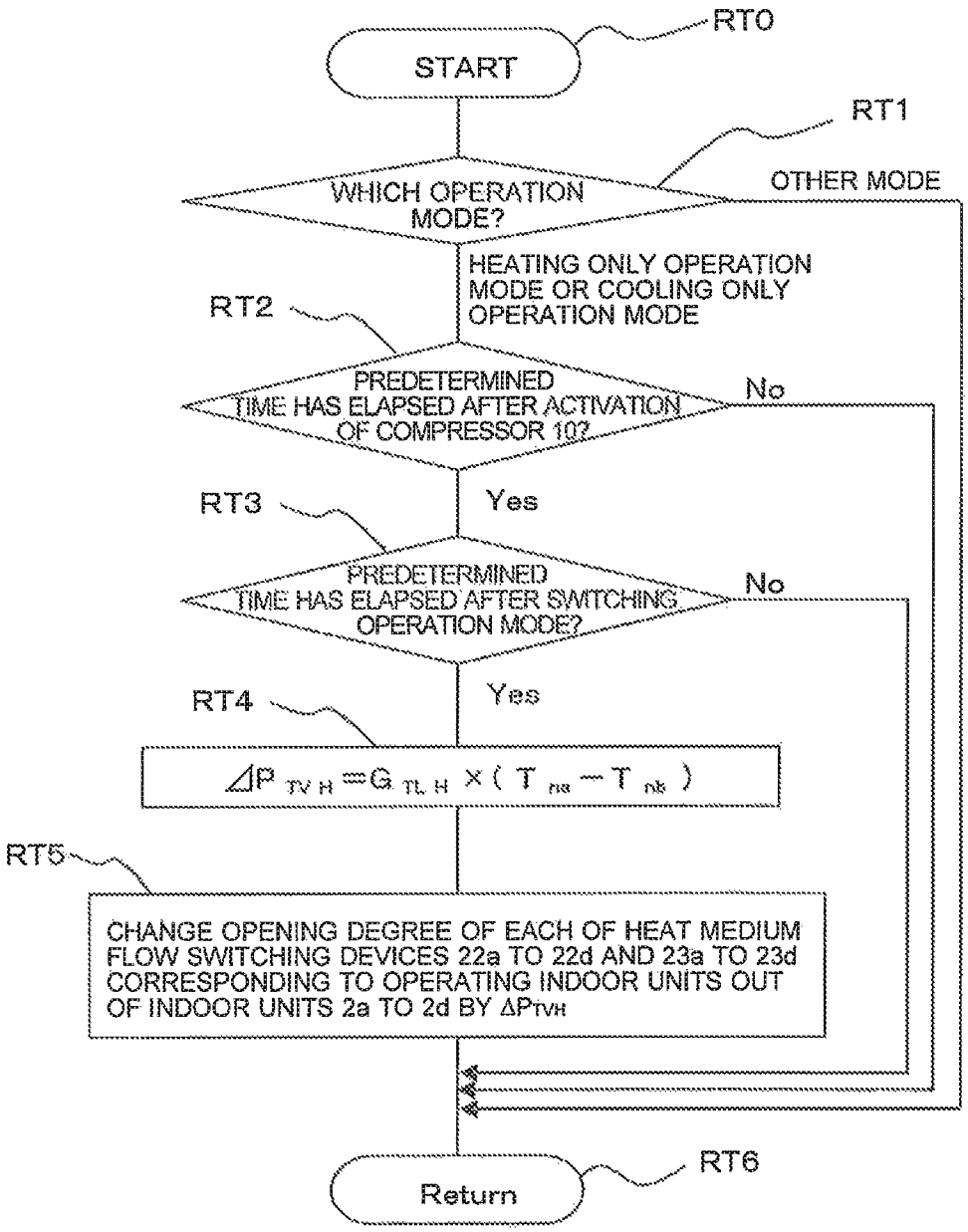
FIG. 9 is a flowchart illustrating a flow of a process of controlling first heat medium flow switching devices and second heat medium flow switching devices.

FIG. 9 is a flowchart illustrating the flow of a process of controlling the first heat medium flow switching devices 22 and the second heat medium flow switching devices 23. The process of controlling the first heat medium flow switching devices 22 and the second heat medium flow switching devices 23 will be specifically described with reference to FIG. 9. As described above, the first heat medium flow switching devices 22 and the second heat medium flow switching devices 23 are controlled by the controller.

Control is started every predetermined time (e.g., 30 seconds) (RT0). When the control is started, the controller determines the current operation mode (RT1). In the case where the operation mode is the heating only operation mode or the cooling only operation mode (RT1: the heating only operation mode or the cooling only operation mode), the controller determines whether a predetermined time (e.g., 10 minutes) has elapsed after activation of the compressor 10 (RT2). If the predetermined time has elapsed after activation of the compressor 10 (RT2: Yes), the controller determines whether a predetermined time (e.g., 10 minutes) has elapsed after switching the operation mode to the heating only operation mode or the cooling only operation mode (RT3). If the predetermined time has elapsed after switching the operation mode (RT3: Yes), the controller performs calculation using the following Equation (1) (RT4).

$$\Delta PTVH = GTLH \times (Tna - Tnb) \quad \text{[Equation (1)]}$$

In this equation, Tna and Tnb denote the temperature of the heat medium detected by the first temperature sensor 31*a* and the temperature detected by the first temperature sensor 31*b*, respectively, GTLH denotes the gain of control, and ΔPTVH denotes the variation (opening-degree correction value) in the opening degree of each of the first heat medium flow switching devices 22 and the second heat medium flow switching devices 23.

Subsequently, the controller changes the opening degree of each of the first heat medium flow switching devices 22 and the second heat medium flow switching devices 23 corresponding to the operating indoor units 2 out of the indoor units 2 by ΔPTVH (RT5). The controller then completes the series of processing steps (RT6). When the operation mode is other than the heating only operation mode and the cooling only operation mode (RT1: other mode), when the predetermined time has not elapsed after activation of the compressor 10 (RT2: No), or when the predetermined time has not elapsed after switching to the heating only operation mode or the cooling only operation mode from the other operation mode (RT3: No), the controller terminates the process (RT6).

A case where assuming that GTLH is 30, when the opening degree PTVH of each of the first heat medium flow switching devices 22 and the second heat medium flow switching devices 23 is 800 that is a middle opening degree, the flow rate of the refrigerant flowing to the heat exchangers related to heat medium 15*a* is lower than that flowing to the heat exchangers related to heat medium 15*b* will now be described. In this case, the temperature of the heat medium on the inlet side of the heat exchangers related to heat medium 15*a* is the same as that on the inlet side of the heat exchangers related to heat medium 15*b*, and the flow rate in the heat exchangers related to heat medium 15*a* is lower than that of the heat exchangers related to heat medium 15*b*. Accordingly, the temperature effectiveness of the heat exchangers related to heat medium 15*a* is improved. Since the heating only operation mode is carried out and the refrigerant has a higher temperature than the heat medium, therefore, an outlet temperature Tna of the heat medium on the outlet side of the heat exchangers related to heat medium 15*a* is higher than an outlet temperature Tnb of that of the heat exchangers related to heat medium 15*b*.

For example, assuming that Tna is higher than Tnb by 2° C., 60 is obtained as ΔPTVH using the above-described Equation (1). Consequently, the opening degree of each of the first heat medium flow switching devices 22 and the second heat medium flow switching devices 23 corresponding to the operating indoor units 2 of the indoor units 2 is controlled so as to be increased by 48 pulses. As described above, each of the first heat medium flow switching devices 22 and the second heat medium flow switching devices 23 is installed so as to have an orientation such that when the opening degree of the device is zero, the passage to or from the heat exchangers related to heat medium 15*a* is totally closed and the passage to or from the heat exchangers related to heat medium 15*b* is fully opened, and when the opening degree thereof is the maximum value, the passage to or from the heat exchangers related to heat medium 15*a* is fully opened and the passage to or from the heat exchangers related to heat medium 15*b* is totally closed.

Accordingly, increasing the opening degree means an increase in flow rate of the refrigerant flowing to the heat exchangers related to heat medium 15*a* and a reduction in flow rate of the refrigerant flowing to the heat exchangers related to heat medium 15*b*. As the flow rate of the refrigerant flowing to the heat exchangers related to heat medium 15*a* increases, the temperature effectiveness of the heat exchangers related to heat medium 15*a* decreases, so that the outlet temperature Tna associated with the heat exchangers related to heat medium 15*a* falls. As the flow rate of the refrigerant flowing to the heat exchangers related to heat medium 15*b* increases, the temperature effectiveness of the heat exchangers related to heat medium 15*b* increases, so that the outlet temperature Tnb associated with the heat exchangers related to heat medium 15*b* rises. Thus, control is performed such that Tna is equal to Tnb.

Furthermore, in the cooling only operation mode, although the same control method as that in the heating only operation mode is performed, as the flow rate of the refrigerant flowing to the heat exchangers related to heat medium 15*a* is increased, the temperature effectiveness of the heat exchangers related to heat medium 15*a* decreases. Accordingly, a change in temperature of the heat medium in the heat exchangers related to heat medium 15*a* decreases, so that the heat medium outlet temperature Tna rises. Furthermore, as the flow rate of the refrigerant flowing to the heat exchangers related to heat medium 15*b* is reduced, the temperature effectiveness of the heat exchangers related to heat medium 15*b* increases, so that the heat medium outlet temperature associated with the heat exchangers related to heat medium 15*b* is closer to the temperature, which is a low temperature, of the heat source side refrigerant. Thus, the heat medium outlet temperature Tnb falls. In other words, as long as the gain GTLH is a negative value in the above-described Equation (1), the values Tna and Tnb are controlled so as to be equal to each other.

Note that the period of control for the first heat medium flow switching devices 22 and the second heat medium flow switching devices 23 has to be longer than that for the heat medium flow control devices 25 (the heat medium flow control devices 25*a* to 25*d*) in order to prevent interference with the control for the heat medium flow control devices 25. Preferably, the control period for the first heat medium flow switching devices 22 and the second heat medium flow switching devices 23 is two or more times longer than that for the heat medium flow control devices 25.

As regards heat source side refrigerants in a two-phase state, many of gas refrigerants have such a tendency that as the quality is higher, the density is lower. Accordingly, the mean density is low, so that pressure loss in the heat exchangers related to heat medium 15 increases. In addition, many of liquid refrigerants as heat source side refrigerants in a two-phase state have such a tendency that as the quality is lower, the density is higher. Accordingly, the mean density is high, so that pressure loss in the heat exchangers related to heat medium 15 decreases.

The heat exchangers related to heat medium 15*b* are connected in series. Heat exchangers having the same heat transfer area may be used, and also the heat transfer area of a heat exchanger positioned downstream of the flow of the heat source side refrigerant may be smaller than that of a heat exchanger positioned upstream thereof in the heating operation during which the heat exchangers each operate as a condenser or a gas cooler. For example, in the case where plate heat exchangers are used as the heat exchangers related to heat medium 15, the number of plates in the heat exchanger on the downstream side may be smaller than that in the heat exchanger on the upstream side. Specifically, for example, the heat exchanger on the upstream side may include 50 plates and the heat exchanger on the downstream side may include 40 plates. Alternatively, the heat exchanger on the upstream side may include 60 plates and the heat exchanger on the downstream side may include 50 plates.

The mean density of the heat source side refrigerant is low on the downstream side in the heating operation. Accordingly, if the heat transfer area of the heat exchanger related to heat medium 15 is small, pressure loss of the heat source side refrigerant does not increase so much, leading to a small reduction in the performance. Such an arrangement therefore enables the system to be constructed inexpensively.

Furthermore, the heat exchanger related to heat medium 15 on the upstream side in the heating operation may include a plurality of heat exchangers related to heat medium 15 connected in parallel. For example, the heat exchanger related to heat medium on the upstream side in the heating operation may include two heat exchangers related to heat medium connected in parallel such that the merged heat medium flows into one heat exchanger related to heat medium 15 positioned on the downstream side. Such an arrangement offers the same advantages as those in the case where the heat exchanger related to heat medium 15 on the upstream and the heat exchanger related to heat medium 15 on the downstream side are allowed to have different numbers of plates in order to provide different heat transfer areas.

Furthermore, three heat exchangers related to heat medium 15 may be arranged for each of a plurality of refrigerant passages such that the three heat exchangers related to heat medium 15 are connected in parallel in one refrigerant passage, and in another refrigerant passage, two of the three heat exchangers related to heat medium 15 are connected in parallel and the remaining one is connected in series to the two heat exchangers related to heat medium 15 connected in parallel.

Additionally, instead of the plurality of heat exchangers related to heat medium 15*a*, a single heat exchanger related to heat medium may be used to reduce pressure loss in the heat exchanger related to heat medium 15*a*. In other words, the heat exchanger related to heat medium 15*a* having a larger cross-sectional area of a refrigerant side passage than the heat exchanger related to heat medium 15*b*(1) and the heat exchanger related to heat medium 15*b*(2) may be used. Assuming that plate heat exchangers are used as the heat exchangers related to heat medium, for example, the heat exchanger related to heat medium 15*a* may include 60 plates and each of the heat exchanger related to heat medium 15*b*(1) and the heat exchanger related to heat medium 15*b*(2) connected in series may include 50 plates.

Furthermore, since pressure loss in a heat exchanger related to heat medium is proportional to the length of a passage, when heat exchangers having the same refrigerant passage area may be used as the heat exchanger related to heat medium 15*a*, the heat exchanger related to heat medium 15*b*(1), and the heat exchanger related to heat medium 15*b*(2) and the length of the refrigerant passage of the heat exchanger related to heat medium 15*a* is shorter than the total length of the refrigerant passages of the heat exchanger related to heat medium 15*b*(1) and the heat exchanger related to heat medium 15*b*(2), pressure loss in the heat exchanger related to heat medium 15*a* is not increased, thus offering the same advantages. Specifically, for example, three plate heat exchangers having the same passage area may be used such that one of them is used as the heat exchanger related to heat medium 15*a* and the other two plate heat exchangers connected in series are used as the heat exchangers related to heat medium 15*b*.

Although Embodiment has been described with respect to the case where the heat medium flows in parallel through all of the heat exchangers related to heat medium 15, the heat exchangers related to heat medium 15*b* may be arranged such that the heat medium flows in series therethrough. In other words, the heat medium passages may be connected such that the heat medium flows through the heat exchanger related to heat medium 15*b*(2) and then flows through the heat exchanger related to heat medium 15*b*(1). This arrangement further improves the efficiency of heat exchange between the refrigerant and the heat medium in the heat exchangers related to heat medium 15*b*. Since pressure loss of the heat medium also increases in this arrangement, however, the arrangement may be applied so long as there is no problem if pressure loss of the heat medium increases.

Furthermore, it is needless to say that the same advantages are offered in any arrangement so long as pressure loss in the refrigerant side passages of the heat exchangers related to heat medium 15*b* is larger than that of the heat exchangers related to heat medium 15*a* and the refrigerant passages of the heat exchangers related to heat medium 15*b* has a longer passage length in a flow direction than that of the heat exchangers related to heat medium 15*a*. For example, if the passage area of the heat exchangers related to heat medium 15*a* is smaller than that of the heat exchanger related to heat medium 15*b*(1) and the heat exchanger related to heat medium 15*b*(2), so long as the heat exchangers related to heat medium are configured such that the length of the refrigerant passage of the heat exchangers related to heat medium 15*a* is sufficiently shorter than the total length of the refrigerant passages of the heat exchanger related to heat medium 15*b*(1) and the heat exchanger related to heat medium 15*b*(2), there is no problem because pressure loss in the refrigerant side passages of the heat exchangers related to heat medium 15*b* is larger than that of the heat exchangers related to heat medium 15*a*.

In the air-conditioning apparatus 100, in the case where only the heating load or cooling load is generated in the use side heat exchangers 26, the corresponding first heat medium flow switching devices 22 and the corresponding second heat medium flow switching devices 23 are controlled at a medium opening degree, such that the heat medium flows into both the heat exchangers related to heat medium 15*a* and the heat exchangers related to heat medium 15*b*. Consequently, since both of the heat exchangers related to heat medium 15*a* and the heat exchangers related to heat medium 15*b* can be used for the heating operation or the cooling operation, the heat transfer area is increased, so that the heating operation or the cooling operation can efficiently be performed.

In addition, in the case where the heating load and the cooling load are simultaneously generated in the use side heat exchangers 26, the first heat medium flow switching device 22 and the second heat medium flow switching device 23 corresponding to the use side heat exchanger 26 which performs the heating operation are switched to the passage connected to the heat exchangers related to heat medium 15*b* for heating, and the first heat medium flow switching device 22 and the second heat medium flow switching device 23 corresponding to the use side heat exchanger 26 which performs the cooling operation are switched to the passage connected to the heat exchangers related to heat medium 15*a* for cooling, so that the heating operation or cooling operation can be freely performed in each indoor unit 2.

Furthermore, each of the first heat medium flow switching devices 22 and the second heat medium flow switching devices 23 described in Embodiment may be any component which can switch passages, for example, a three-way valve capable of switching between flow directions in a three-way passage or two two-way valves, such as on-off valves, opening or closing a two-way passage used in combination. Alternatively, as each of the first heat medium flow switching devices 22 and the second heat medium flow switching devices 23, for example, a stepping-motor-driven mixing valve, capable of changing a flow rate in a three-way passage may be used, or, two electronic expansion valves, capable of changing a flow rate in a two-way passage may be used in combination. In this case, water hammer caused when a passage is suddenly opened or closed can be prevented. Furthermore, while Embodiment has been described with respect to the case where each of the heat medium flow control devices 25 is a two-way valve, each of the heat medium flow control devices 25 may be a control valve having a three-way passage and the valve may be disposed with a bypass pipe that bypasses the corresponding use side heat exchanger 26.

Furthermore, each of the heat medium flow control devices 25 may be a two-way valve or a three-way valve whose one end is closed as long as it is capable of controlling a flow rate in a passage in a stepping-motor-driven manner. Alternatively, each of the heat medium flow control devices 25 may be an on-off valve and the like, opening or closing a two-way passage such that the average flow rate is controlled while ON and OFF operations are repeated.

Furthermore, while each second refrigerant flow switching device 18 is illustrated as a four-way valve, the device is not limited to this valve. A plurality of two-way or three-way flow switching valves may be used such that the refrigerant flows in the same way.

While the air-conditioning apparatus 100 according to Embodiment has been described with respect to the case where the apparatus can perform the cooling and heating mixed operation, the apparatus is not limited to this case. For example, if the apparatus is configured such that one heat exchanger related to heat medium 15 and one expansion device 16 are arranged, each device is connected to a plurality of use side heat exchangers 26 arranged in parallel and a plurality of heat medium flow control devices 25 arranged in parallel, and either the cooling operation or the heating operation can be performed, the same advantages can be achieved.

In addition, it is needless to say that the same holds true for the case where one use side heat exchanger 26 and one heat medium flow control device 25 are connected. Moreover, obviously, there is no problem if a plurality of components acting in the same way are arranged as the heat exchanger related to heat medium 15 and the expansion device 16. Furthermore, while the case where the heat medium flow control devices 25 are arranged in the heat medium relay unit 3 has been described, the arrangement is not limited to this case. Each heat medium flow control device 25 may be disposed in the indoor unit 2. The heat medium relay unit 3 may be separated from the indoor unit 2.

As the heat source side refrigerant, for example, a single refrigerant, such as R-22, R-134a, or R-32, a near-azeotropic refrigerant mixture, such as R-410A or R-404A, a non-azeotropic refrigerant mixture, such as R-407C, a refrigerant, such as CF3CF=CH2, containing a double bond in its chemical formula and having a relatively low global warming potential, a mixture containing these refrigerant, or a natural refrigerant, such as CO2 or propane, can be used. In the heat exchangers related to heat medium 15*a* or the heat exchangers related to heat medium 15*b* which operate for heating, a refrigerant that undergoes a usual two-phase change is condensed and liquefied and a refrigerant, such as CO2, which undergoes a transition to a supercritical state is cooled in the supercritical state. As for the rest, either of them acts in the same way and offers the same advantages.

As the heat medium, for example, brine (antifreeze), water, a mixed solution of brine and water, or a mixed solution of water and an additive with high anticorrosive effect can be used. In the air-conditioning apparatus 100, therefore, if the heat medium leaks through the indoor unit 2 into the indoor space 7, the safety of the heat medium used is high. Accordingly, it contributes to safety improvement.

While Embodiment has been described with respect to the case where the air-conditioning apparatus 100 includes the accumulator 19, the accumulator 19 may not be provided. Typically, each of the heat source side heat exchanger 12 and the use side heat exchangers 26 is provided with an air-sending device and in many cases, air sending facilitates condensation or evaporation. However, the structure is not limited to this case. For example, a panel heater and the like, taking advantage of radiation can be used as the use side heat exchanger 26 and a water-cooled heat exchanger which transfers heat using water or antifreeze can be used as the heat source side heat exchanger 12. In other words, any type of heat exchanger configured to be capable of transferring heat or removing heat can be used as each of the heat source side heat exchanger 12 and the use side heat exchanger 26.

While Embodiment has been described with respect to the case where the four use side heat exchangers 26 are arranged, the number of use side heat exchangers is not particularly limited. In addition, while Embodiment has been described with respect to the case where two heat exchangers function as the heat exchangers related to heat medium 15*a* and two heat exchangers function as the heat exchangers related to heat medium 15*b*, obviously, the arrangement is not limited to this case. As long as each heat exchanger related to heat medium 15 is configured to be capable of cooling or/and heating the heat medium, the number of heat exchangers related to heat medium 15 arranged is not limited. Furthermore, as regards each of the pump 21*a* and the pump 21*b*, the number of pumps is not limited to one. A plurality of pumps having a small capacity may be connected in parallel.

As described above, the air-conditioning apparatus 100 according to Embodiment can improve safety without allowing the heat source side refrigerant to circulate in or near the indoor unit 2 and can further allow the heat medium leaked from connections between the pipe 5 and each actuator to be held in the heat medium relay unit 3, thus further improving safety. Additionally, the air-conditioning apparatus 100 can save energy because the pipes 5 can be made shorter. Moreover, the air-conditioning apparatus 100 includes a reduced number of pipes (the refrigerant pipes 4, the pipes 5) connecting the outdoor unit 1 and the heat medium relay unit 3 or connecting the heat medium relay unit 3 and the indoor unit 2 to make the installation easier. Moreover, the air-conditioning apparatus 100 can improve the heat exchange efficiency in the heat exchangers related to heat medium 15 while miniaturizing the heat medium relay unit 3, thus energy can be saved.

The invention claimed is:

1. An air-conditioning apparatus comprising:

a refrigerant circuit in which a compressor, a first refrigerant flow switching device, a heat source side heat exchanger, a plurality of expansion devices, refrigerant passages of a plurality of heat exchangers related to heat medium, and a plurality of second refrigerant flow switching devices are connected by refrigerant pipes to circulate refrigerant;

a heat medium circuit in which a pump, a plurality of use side heat exchangers, heat medium side passages of the plurality of heat exchangers related to heat medium, and a plurality of heat medium flow switching devices arranged on the inlet side and the outlet side of the plurality of use side heat exchangers are connected by heat medium pipes to circulate a heat medium; and a controller configured to calculate an opening-degree correction value for the plurality of heat medium flow switching devices on the basis of a temperature of the heat medium flowing out from the plurality of heat exchangers related to the heat medium, wherein the plurality of heat exchangers related to heat medium exchange heat between the refrigerant and the heat medium, wherein the refrigerant circuit branches into a plurality of refrigerant passages including at least a first refrigerant passage and a second refrigerant passage, wherein each first refrigerant passage connects to a corresponding expansion device and to a corresponding second refrigerant flow switching device through a first heat exchanger related to heat medium connected between the corresponding expansion device and the corresponding second refrigerant flow switching device of each first refrigerant passage, wherein each second refrigerant passage connects to a corresponding expansion device and to a corresponding second refrigerant flow switching device through a second heat exchanger related to heat medium connected between the corresponding expansion device and the corresponding second refrigerant flow switching device of each first refrigerant passage, wherein the air-conditioning apparatus is configured such that pressure loss in a refrigerant passage of the second heat exchanger related to heat medium is larger than pressure loss in a refrigerant passage of the first heat exchanger related to heat medium and such that the refrigerant passage of the second heat exchanger related to heat medium has a longer passage length in a flow direction than the refrigerant passage of the first heat exchanger related to heat medium, and while the flow rate of the refrigerant of the refrigerant passage of the first heat exchanger related to heat medium is substantially the same as the flow rate of the refrigerant of the refrigerant passage of the second heat exchanger related to heat medium, and wherein the controller is configured to control simultaneously, in accordance with the opening-degree correction value, an opening degree of all of the plurality of heat medium flow switching devices corresponding to the plurality of use side heat exchangers through which the heat medium flowing out from the plurality of heat exchangers related to heat medium circulates.

2. The air-conditioning apparatus of claim 1, wherein the first heat exchanger related to heat medium is configured such that the refrigerant flows in parallel between the expansion device and the second refrigerant flow switching device, and wherein the second heat exchanger related to heat medium is configured such that the refrigerant flows in series between the expansion device and the second refrigerant flow switching device.

3. The air-conditioning apparatus of claim 1 provided with a function of switching operation modes including a heating only operation mode in which the heat medium is heated by all of the plurality of heat exchangers related to heat medium, a cooling only operation mode in which the heat medium is cooled by all of the plurality of heat exchangers related to heat medium, and a cooling and heating mixed operation mode in which the heat medium is heated by a part of the plurality of heat exchangers related to heat medium and the heat medium is cooled by a rest of the plurality of heat exchangers related to heat medium, wherein in the heating only operation mode, the refrigerant is allowed to flow, in each of the refrigerant passages, through the second refrigerant flow switching device, the heat exchanger related to heat medium, and the expansion device in that order, wherein in the cooling only operation mode, the refrigerant is allowed to flow, in each of the refrigerant passages, through the expansion device, the heat exchanger related to heat medium, and the second refrigerant flow switching device in that order, and wherein in the cooling and heating mixed operation mode, the refrigerant is allowed to flow through the second refrigerant flow switching device, the heat exchanger related to heat medium, and the expansion device that constitute the part of the refrigerant passages, in that order and then flow through the expansion device, the heat exchanger related to heat medium, and the second refrigerant flow switching device that constitute rest of the refrigerant passages, in that order.

4. The air-conditioning apparatus of claim 3, wherein the heat medium flow switching devices have an opening degree controlled such that the amount of heat exchanged in the heat exchangers related to heat medium is controlled in the cooling only operation mode or the heating only operation mode.

5. The air-conditioning apparatus of claim 3, wherein the refrigerant passage of the first heat exchanger related to heat medium which operates as an evaporator in the cooling and heating mixed operation mode is a refrigerant passage on a cooling side, and wherein the refrigerant passage of the second heat exchanger related to heat medium, which operates as a condenser or a gas cooler in the cooling and heating mixed operation mode, is a refrigerant passage on a heating side.

6. The air-conditioning apparatus of claim 1, further comprising:

in each of the plurality of refrigerant passages, two heat exchangers related to heat medium are arranged, wherein the two heat exchangers related to heat medium in the part of the refrigerant passages are connected in parallel, and wherein the two heat exchangers related to heat medium in the rest of the refrigerant passages are connected in series.

7. The air-conditioning apparatus of claim 6, wherein in the two heat exchangers related to heat medium connected in series, a heat transfer area of a heat exchanger related to heat medium positioned downstream in a flow direction of the refrigerant during the heating operation is smaller than a heat transfer area of a heat exchanger related to heat medium positioned upstream.

8. The air-conditioning apparatus of claim 7, wherein the heat exchanger related to heat medium positioned upstream includes a plurality of heat exchangers connected in parallel relative to the flow direction of the refrigerant.

9. The air-conditioning apparatus of claim 1, further comprising:

wherein each of the first and second refrigerant passages has three heat exchangers related to heat medium, wherein the three heat exchangers related to heat medium of each first refrigerant passage are connected in parallel, and wherein two of the three heat exchangers related to the heat medium of each second refrigerant passage are connected in parallel.

10. The air-conditioning apparatus of claim 1, wherein the heat medium is allowed to flow in parallel to all of the plurality of heat exchangers related to heat medium.

11. The air-conditioning apparatus of claim 1, wherein the opening-degree correction value is calculated on the basis of a difference in temperature between the heat medium flowing from the heat exchanger related to heat medium on a heating side and the heating medium flowing from a heat exchanger related to heat medium on the cooling side.

12. The air-conditioning apparatus of claim 1, wherein the plurality of heat exchangers related to heat medium connected such that the refrigerant flows in series therethrough are connected by pipes such that the heat medium flows in series therethrough, and wherein the plurality of heat exchangers related to heat medium connected such that the refrigerant flows in parallel therethrough are connected by pipes such that the heat medium flows in parallel therethrough.

13. The air-conditioning apparatus of claim 12, further comprising a plurality of heat medium flow control devices, each of the plurality of heat medium flow control devices being disposed on an inlet side or an outlet side of the corresponding plurality of use side heat exchangers, wherein a control period for the heat medium flow switching devices is longer than a control period for the heat medium flow control device.

14. The air-conditioning apparatus of claim 13, wherein a ratio of the control period for the heat medium flow switching devices to the control period for the heat medium flow control device is greater than or equal to 2.

15. The air-conditioning apparatus of claim 12, wherein a control gain in the heating only operation mode and a control gain in the cooling only operation mode are set to different values.

16. The air-conditioning apparatus of claim 1, further comprising:

an indoor unit including the plurality of use side heat exchanger;

a heat medium relay unit including the plurality of heat exchangers related to heat medium and the pump; and an outdoor unit including the compressor and the heat source side heat exchanger, wherein the indoor unit, the heat medium relay unit, and the outdoor unit are separated from one another such that they are allowed to be arranged at separate positions.

17. The air-conditioning apparatus of claim 16, wherein the outdoor unit is connected to the heat medium relay unit by two pipes and the heat medium relay unit is connected to the indoor unit by two pipes.

18. The air-conditioning apparatus of claim 1, further comprising:

wherein each of the first and second refrigerant passages has two heat exchangers related to the heat medium, wherein the two heat exchangers related to the heat medium of each first refrigerant passage are connected in parallel, and wherein the two heat exchangers related to the heat medium of each second refrigerant passage are connected in series to each other and connected in parallel to the two heat exchangers related to the heat medium of each first refrigerant passage.

19. An air-conditioning apparatus comprising:

a refrigerant circuit in which a compressor, a first refrigerant flow switching device, a heat source side heat exchanger, a plurality of expansion devices, refrigerant passages of a plurality of heat exchangers related to heat medium, and a plurality of second refrigerant flow switching devices are connected by refrigerant pipes to circulate refrigerant;

a heat medium circuit in which a pump, a plurality of use side heat exchangers, heat medium side passages of the plurality of heat exchangers related to heat medium, a plurality of heat medium flow switching devices arranged on an inlet side and an outlet side of the plurality of use side heat exchangers are connected by heat medium pipes to circulate a heat medium, and two temperature sensors configured to detect temperatures of the heat medium on an outlet side of the plurality of heat exchangers; and a controller configured to calculate an opening-degree correction value for the plurality of heat medium flow switching devices on the basis of detected temperatures of the heat medium flowing out from the plurality of heat exchangers related to the heat medium, wherein the plurality of heat exchangers related to heat medium exchange heat between the refrigerant and the heat medium, wherein the refrigerant circuit branches into a plurality of refrigerant passages including at least a first refrigerant passage and a second refrigerant passage, wherein each first refrigerant passage connects to a corresponding expansion device and to a corresponding second refrigerant flow switching device through a first heat exchanger related to heat medium connected between the corresponding expansion device and the corresponding second refrigerant flow switching device of each first refrigerant passage, wherein each second refrigerant passage connects to a corresponding expansion device and to a corresponding second refrigerant flow switching device through a second heat exchanger related to heat medium connected between the corresponding expansion device and the corresponding second refrigerant flow switching device of each first refrigerant passage, wherein the air-conditioning apparatus is configured such that pressure loss in a refrigerant passage of the second heat exchanger related to heat medium is larger than pressure loss in a refrigerant passage of the first heat exchanger related to heat medium and such that the refrigerant passage of the second heat exchanger related to heat medium has a longer passage length in a flow direction than the refrigerant passage of the first heat exchanger related to heat medium, and while the flow rate of the refrigerant of the refrigerant passage of the first heat exchanger related to heat medium is substantially the same as the flow rate of the refrigerant of the refrigerant passage of the second heat exchanger related to heat medium, and wherein the controller is configured to control simultaneously, in accordance with the opening-degree correction value, an opening degree of all of the plurality of heat medium flow switching devices corresponding to the plurality of use side heat exchangers through which the heat medium flowing out from the plurality of heat exchangers related to heat medium circulates.

20. The air-conditioning apparatus of claim 19, wherein the first heat exchanger related to heat medium is configured such that the refrigerant flows in parallel between the expansion device and the second refrigerant flow switching device, and wherein the second heat exchanger related to heat medium is configured such that the refrigerant flows in series between the expansion device and the second refrigerant flow switching device.

* * * * *